US009414451B2

(12) United States Patent
Seki et al.

(10) Patent No.: US 9,414,451 B2
(45) Date of Patent: Aug. 9, 2016

(54) LIGHTING DEVICE AND LUMINAIRE

(71) Applicant: Panasonic Intellectual Property Management Co., Ltd., Osaka (JP)

(72) Inventors: Keisuke Seki, Osaka (JP); Takeshi Kamoi, Kyoto (JP); Daisuke Yamahara, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/572,990

(22) Filed: Dec. 17, 2014

(65) Prior Publication Data

US 2015/0173133 A1 Jun. 18, 2015

(30) Foreign Application Priority Data

Dec. 18, 2013 (JP) ..... 2013-261624
Dec. 19, 2013 (JP) ..... 2013-262717

(51) Int. Cl.
*H05B 37/02* (2006.01)
*H05B 33/08* (2006.01)

(52) U.S. Cl.
CPC ..... *H05B 33/0818* (2013.01)

(58) Field of Classification Search
CPC ..... H05B 33/0881
USPC ..... 315/209 R, 210, 219, 291, 294, 299, 315/300, 306, 307, 308, 185 R
See application file for complete search history.

(56) References Cited

U.S. PATENT DOCUMENTS 8,120,201 B2 * 2/2012 Fujino ..... H02M 3/33507 307/10.8
8,274,237 B2 * 9/2012 Nagase ..... H05B 33/089 315/185 S
8,810,160 B2 * 8/2014 Hoogzaad ..... H05B 33/0818 315/224
2006/0176411 A1 8/2006 Furukawa
2006/0209478 A1 9/2006 Arai et al.
2011/0109247 A1 * 5/2011 Hoogzaad ..... H05B 33/0818 315/294
2011/0199023 A1 * 8/2011 Zimmermann .... H05B 33/0818 315/297
2013/0016310 A1 1/2013 Kanemitsu et al.
2014/0300274 A1 * 10/2014 Acatrinei ..... H05B 33/0815 315/85

FOREIGN PATENT DOCUMENTS

JP 2002-25784 1/2002
JP 2003-208993 7/2003

(Continued)

*Primary Examiner* — Thuy Vinh Tran
(74) *Attorney, Agent, or Firm* — Renner, Otto, Boisselle & Sklar, LLP

(57) ABSTRACT

A lighting device includes a constant-current circuit, a smoothing capacitor, a bypass circuit, a detection unit, and a bypass control unit. The constant-current circuit supplies a constant current to a plurality of solid-state light-emitting elements connected in series. The smoothing capacitor is connected between output terminals of the constant-current circuit. The bypass circuit is connected in parallel to one or more of the plurality of solid-state light-emitting elements. The detection unit detects whether the one or more solid-state light-emitting elements are open-circuited. When the detection unit detects that at least one of the one or more solid-state light-emitting elements is open-circuited, the bypass control unit discharges the smoothing capacitor during a discharge period to then bypass the one or more solid-state light-emitting elements through the bypass circuit.

19 Claims, 34 Drawing Sheets

(56) References Cited

FOREIGN PATENT DOCUMENTS

| | | |
|---|---|---|
| JP | 2005-310999 | 11/2005 |
| JP | 2006-261427 | 9/2006 |
| JP | 2008-131007 | 6/2008 |
| JP | 2008-204866 | 9/2008 |
| JP | 2008-205036 | 9/2008 |
| JP | 2009-38247 | 2/2009 |
| JP | 2010-55824 | 3/2010 |
| JP | 2011-14367 | 1/2011 |
| JP | 2012/005239 | 1/2012 |
| JP | 2013-21117 | 1/2013 |
| WO | 2012/026216 | 3/2012 |

* cited by examiner

LIGHTING DEVICE AND LUMINAIRE

CROSS-REFERENCE TO RELATED APPLICATION

This application claims the benefit of priorities of Japanese Patent Application Nos. 2013-261624, filed on Dec. 18, 2013 and 2013-262717, filed on Dec. 19, 2013, the entire contents of which are hereby incorporated by reference.

TECHNICAL FIELD

The present invention relates to a lighting device of a solid-state light-emitting element such as an LED (light-emitting diode), and a luminaire having the lighting device.

BACKGROUND ART

A solid-state light-emitting element such as an LED is attracting attention as a light source for a variety of products since it is smaller, more efficient, and lasts longer.

Examples of products using LEDs as a light source include a luminaire. The number of LEDs used in a luminaire is determined based on a desired brightness. Typically, a number of LEDs are used for a single luminaire. When a number of LEDs are used in a luminaire, the LEDs may be connected in series to one another. In this arrangement, the same current is supplied to the LEDs, and accordingly unevenness in brightness of the LEDs can be suppressed.

For the arrangement in which LEDs are connected in series to one another, if one of the LEDs has an open-circuit failure, current supply is stopped for all of the LEDs, so that the other normal LEDs are not lit as well. In order to address this problem, a technique is known, in which a bypass circuit is connected in parallel to each of the LEDs, and the bypass circuit is turned on when an open-circuit failure occurs in the corresponding LED to thereby supply current to the other normal solid-state light-emitting elements (see, e.g., Japanese Unexamined Patent Application Publication Nos. 2005-310999, 2008-204866, 2003-208993, and 2009-038247).

For such a luminaire, however, excessive current may flow in the other normal LEDs when the bypass circuit is operated. As a result, the normal LEDs may deteriorate or fail.

For example, in the disclosure of Japanese Unexamined Patent Application Publication No. 2009-038247, a bypass circuit is connected in parallel to each of LEDs connected in series, and if an increase in the voltage across an LED having an open-circuit failure is detected, a bypass switch in a corresponding bypass circuit is turned on. In this instance, however, immediately after the bypass switch is turned on, excessive current flows in the other LEDs having no open-circuit failure and in the corresponding bypass circuit. Therefore, in the above disclosure, normal LEDs may deteriorate or fail. In order to prevent the LEDs from deteriorating or failing, the LEDs or the like need to be robust to stress due to such excessive current, causing the cost and size to be increased.

Hereinafter, such a problem will be described in more detail with reference to FIGS. 1A and 1B and FIG. 2.

FIG. 1A is a circuit diagram of a luminaire having bypass circuits. The luminaire shown in FIG. 1A includes: light-emitting elements 103*a* and 103*b* connected in series; a bypass circuit 104*a* connected in parallel to the light-emitting element 103*a*; a bypass circuit 104*b* connected in parallel to the light-emitting element 103*b*; a constant-current circuit 101 for supplying constant current to the light-emitting elements 103*a* and 103*b*; and a smoothing capacitor 102 connected between output terminals of the constant-current circuit 101. The light-emitting elements 103*a* and 103*b* are, e.g., LEDs.

In this luminaire, if the light-emitting element 103*b* has an open-circuit failure, the bypass circuit 104*b* is turned on as shown in FIG. 1B. By doing so, current is supplied to the light-emitting element 103*a*. As such, the luminaire can prevent that all of the light-emitting elements are lit out when one of them has an open-circuit failure.

Further, in this luminaire, the output voltage VC from the constant-current circuit 101 is monitored, for example, and it is detected that the light-emitting element 103 or 103*b* has an open-circuit failure if the voltage VC rises above a predetermined voltage.

In this regard, the present inventors have found out that such a luminaire has the following problem.

FIG. 2 shows graphs of the voltage VC versus time and a current I flowing in the normal light-emitting element 103*a* versus time, in the case where an open-circuit failure occurs.

Before time t1 at which an open-circuit failure occurs, the voltage VC is equal to the sum of forward voltages of the two light-emitting elements 103*a* and 103*b* (2×Vf). When an open-circuit failure occurs at time t1, no current flows in the normal light-emitting element 103*a* and the voltage VC rises. At time t2, the voltage VC rises above a predetermined voltage (i.e., VC>2×Vf). Accordingly, the bypass circuit 104*b* is turned on.

As the bypass circuit 104*b* is turned on, the voltage VC decreases up to a voltage equal to the forward voltage Vf of the normal light-emitting element 103*a*. However, at the moment when the bypass circuit 104*b* is turned on, the voltage VC is higher than the voltage 2×Vf, and electric charges corresponding to this voltage have been accumulated in the smoothing capacitor 102. Therefore, at the moment when the bypass circuit 104*b* is turned on, electric charges accumulated in the smoothing capacitor 102, which correspond to a difference voltage (>Vf) between the voltage (>2×Vf) and the forward voltage Vf (i.e., electric charges which correspond to the forward voltage Vf of the light-emitting element 103*b* having the open-circuit failure) flow in the normal light-emitting element 103*a* at a burst (from time t2 to time t3).

As such, excessive current may flow in the normal light-emitting element 103*a* so that the normal light-emitting element 103*a* may deteriorate or break down. In addition, when excessive current flows in the light-emitting element 103*a*, the bypass circuit 104*a* may be erroneously turned on.

In order to suppress excessive current from flowing in the normal light-emitting element 103*a*, the bypass circuit 104*b* having a forward voltage equal to the forward voltage of the light-emitting element 103*b* may be provided. However, this approach may cause another problem in that the bypass circuit 104*b* has more power loss.

As a technology to suppress such excessive current, there is known a technique in which a voltage drop unit is provided in a bypass circuit (see, e.g., International Publication No. WO 2012/005239). According to this reference, a resistor is provided in a bypass circuit as a voltage drop unit, so that it reduces current flowing immediately after a bypass switch in the bypass circuit is turned on, thereby suppressing stress exerted on LEDs or the like.

In this approach, however, the power loss is continuously generated by the voltage drop unit after connecting two ends of the LED having the open-circuit failure.

SUMMARY OF THE INVENTION

In view of the above, the present invention provides a lighting device, with solid-state light-emitting elements connected in series and bypass circuits, capable of suppressing excessive current from flowing in normal light-emitting elements at the moment when a bypass circuit is turned on.

In accordance with an aspect of the present invention, there is provided a lighting device including: a constant-current circuit configured to supply a constant current to a plurality of solid-state light-emitting elements connected in series; a smoothing capacitor connected between output terminals of the constant-current circuit; a bypass circuit connected in parallel to one or more of the plurality of solid-state light-emitting elements, the bypass circuit configured to bypass the one or more solid-state light-emitting elements; a detection unit configured to detect whether the one or more solid-state light-emitting elements are open-circuited; and a bypass control unit configured to, when the detection unit detects that at least one of the one or more solid-state light-emitting elements is open-circuited, discharge the smoothing capacitor during a discharge period to then bypass the one or more solid-state light-emitting elements through the bypass circuit.

Further, during the discharge period, the smoothing capacitor may be discharged until a voltage across the smoothing capacitor becomes smaller than a sum of forward voltages of the plurality of solid-state light-emitting elements.

Further, during the discharge period, the smoothing capacitor may be discharged until the voltage across the smoothing capacitor becomes smaller than a sum of forward voltages of other solid-state light-emitting elements than the one or more solid-state light-emitting elements among the plurality of solid-state light-emitting elements.

Further, during the discharge period, the bypass control unit may stop the constant-current circuit or may reduce a value of the constant current supplied from the constant-current circuit.

Further, the lighting device may further include a discharge circuit connected in parallel to the smoothing capacitor, wherein, during the discharge period, the bypass control unit may turn on the discharge circuit to discharge the smoothing capacitor.

Further, the bypass control unit may include a comparator to compare a voltage across the smoothing capacitor with a predetermined reference voltage, and the bypass control unit may terminate the discharge period when the voltage across the smoothing capacitor becomes lower than the reference voltage, and may bypass the one or more solid-state light-emitting elements through the bypass circuit.

Further, after the detection unit detects that said at least one of the one or more solid-state light-emitting elements is open-circuited, the bypass control unit may terminate the discharge period after a predetermined time period has elapsed and may bypass the one or more solid-state light-emitting elements through the bypass circuit.

Further, the discharge period may be longer than a time constant of a discharge path through which the smoothing capacitor is discharged.

Further, the constant-current circuit may be a DC-to-DC converter that is supplied with a current from a DC power source, and the constant-current circuit may include: a switching element; an inductor through which the current from the DC power source flows when the switching element is turned on; a diode through which a current discharged from the inductor is supplied to the plurality of solid-state light-emitting elements; and a control unit for controlling on and off of the switching element.

In accordance with another aspect of the present invention, there is provided a lighting device including: a constant-current circuit configured to supply a constant current to a plurality of solid-state light-emitting elements connected in series; a capacitor circuit connected in parallel to one or more of the plurality of solid-state light-emitting elements, the capacitor circuit including a capacitor; a bypass switch circuit connected in parallel to the one or more solid-state light-emitting elements and to the capacitor circuit, the bypass switch circuit including a bypass switch; and a current detection unit configured to measure a current flowing through the capacitor, wherein the current detection unit turns on the bypass switch when the measured current exceeds a predetermined threshold.

Further, the capacitor circuit may further include a resistor connected in series to the capacitor, and the current detection unit may measure the current based on a voltage across the resistor.

Further, the current detection unit may include a resistor-capacitor filter to attenuate high-frequency components in the current.

Further, the bypass switch circuit may further include an impedance element connected in series to the bypass switch.

Further, the constant-current circuit may be a DC-to-DC converter that is supplied with current from a DC power source, and the constant-current circuit may include: a switching element; a control circuit that outputs a signal to control on and off of the switching element; an inductive element through which the current from the DC power source flows when the switching element is turned on; and a diode through which a current discharged from the inductive element is supplied to the plurality of solid-state light-emitting elements.

Further, the current detection unit may detect a DC component in the current flowing through the capacitor.

Further, the constant-current circuit may be driven in a boundary current mode, and the predetermine threshold may be larger than a value of the constant current supplied from the constant-current circuit and may be equal to or less than two times the value.

In accordance with yet another aspect of the present invention, there is provided a luminaire including: the lighting device described above; and the plurality of solid-state light-emitting elements that receive the constant current from the lighting device.

In accordance with the aspects of the present invention, in a lighting device with solid-state light-emitting elements connected in series and bypass circuits, the lighting device can suppress excessive current from flowing in normal light-emitting elements at the moment when a bypass circuit is turned on.

Accordingly, it is possible to prevent the normal light-emitting elements from deteriorating or failing.

BRIEF DESCRIPTION OF THE DRAWINGS

The objects and features of the present invention will become apparent from the following description of embodiments, given in conjunction with the accompanying drawings, in which.

DETAILED DESCRIPTION

Hereinafter, embodiments of the present invention will be described with reference to the accompanying drawings. In the following descriptions, embodiments to be described below are all to provide preferable examples of the present invention. Therefore, the numerical values, shapes, materials, elements, arrangement of elements, connection manner and the like are merely illustrative but are not limited to those to be suggested in the following embodiments. Accordingly, among the elements described in the embodiments, those not recited in the broadest independent claims are meant to be selective elements. In addition, the drawings are schematic views and are not strictly depicted.

First Embodiment

According to the first embodiment, when an open-circuit failure has occurred, a luminaire releases electric charges accumulated in a smoothing capacitor and then turns on a bypass circuit. Specifically, the luminaire releases electric charges accumulated in the smoothing capacitor by interrupting a constant-current circuit for a predetermined time period after the open-circuit failure has occurred. By doing so, it is possible to suppress excessive current flowing in normal light-emitting elements when the bypass circuit is turned on.

Figure 1A:
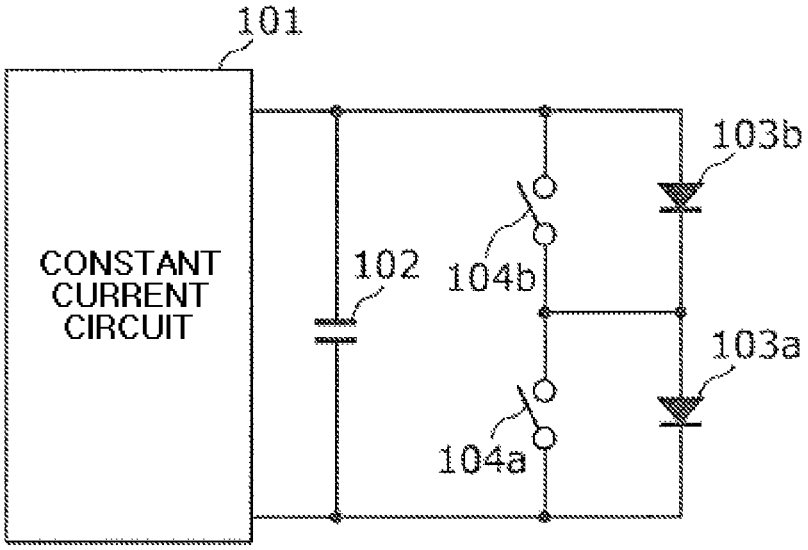
FIG. 1A (RELATED ART)
FIG. 1A is a circuit diagram of a luminaire having bypass circuits.
Figure 1B:
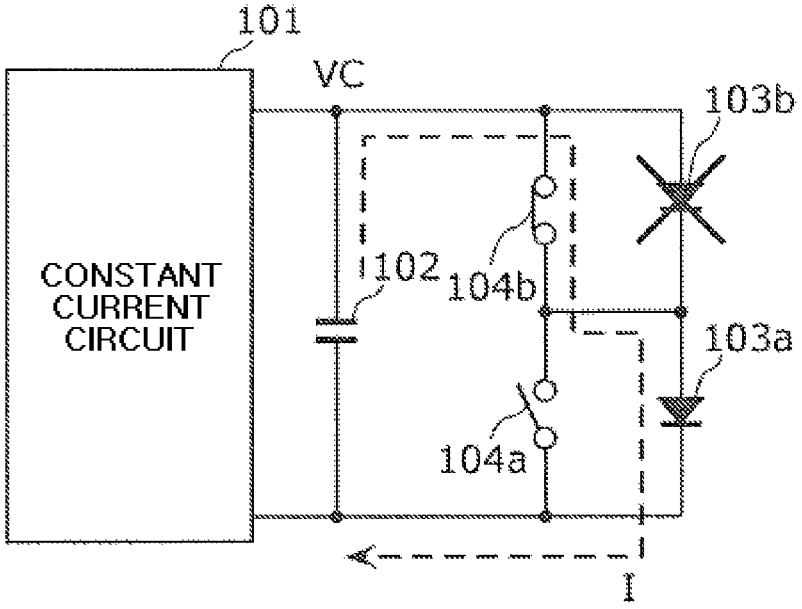
FIG. 1B (RELATED ART)
FIG. 1B is a circuit diagram showing an operation example of a luminaire having bypass circuits.
Figure 2:
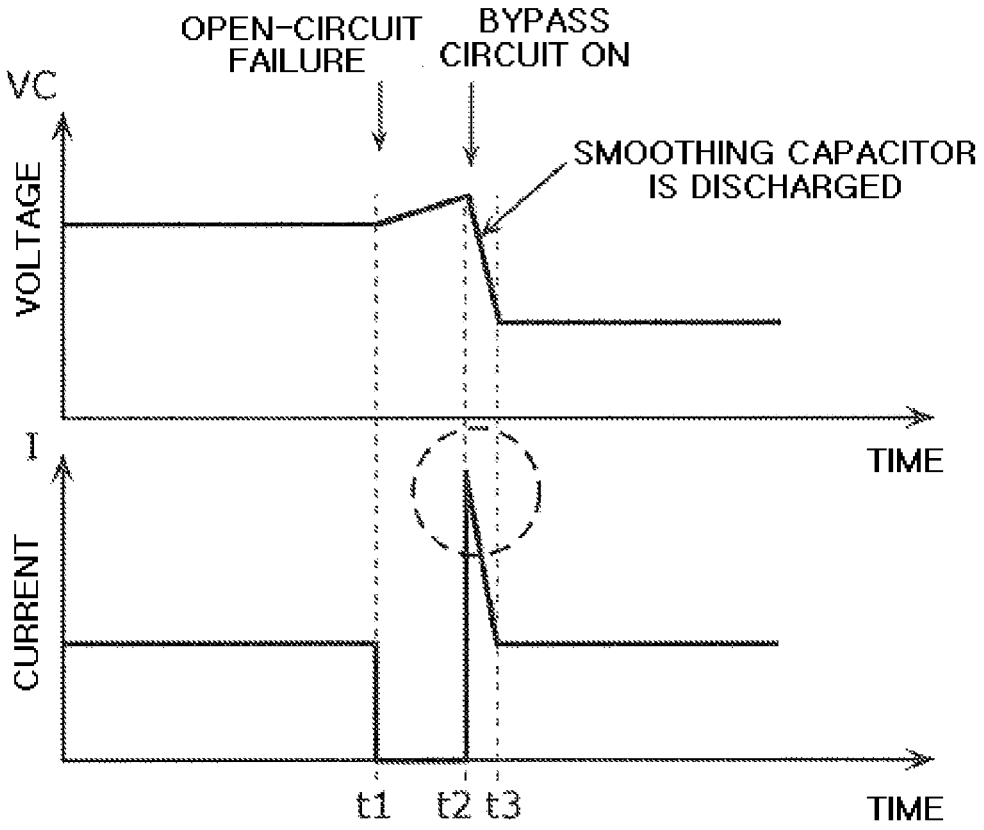
FIG. 2 (RELATED ART)
FIG. 2 is a timing chart showing a voltage and a current when a bypass circuit operates.
Figure 3:
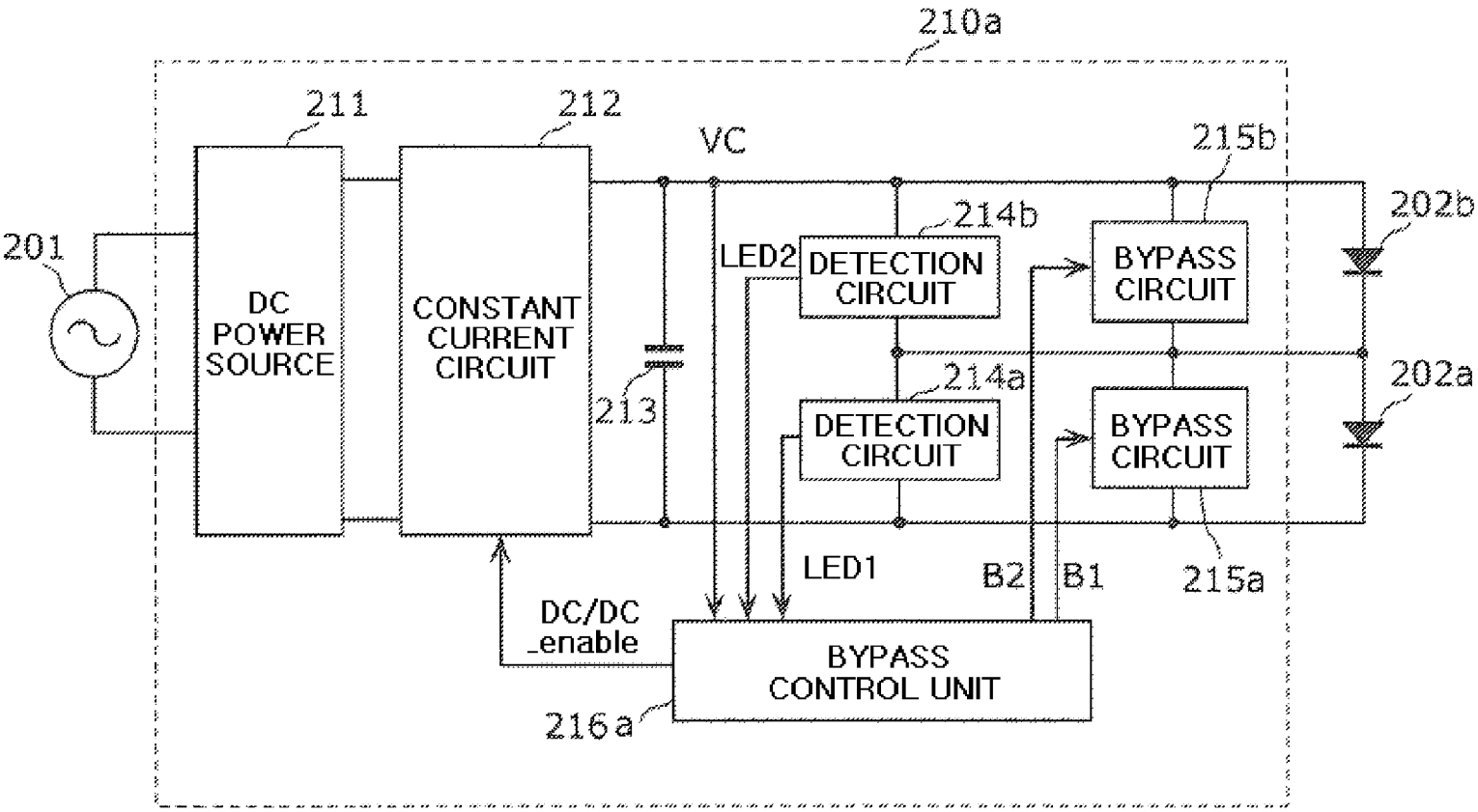
FIG. 3 is a schematic circuit diagram of a lighting device according to a first embodiment.

FIG. 3 is a circuit diagram of a lighting device 210*a* according to the first embodiment of the present invention.

The lighting device 210*a* lights solid-state light-emitting elements connected in series to each other, e.g., LEDs 202*a* and 202*b*, by using power from a commercial power source 201. The lighting device 210*a* includes a DC power source 211, a constant-current circuit 212, a smoothing capacitor 213, a detection circuits 214*a* and 214*b*, bypass circuits 215*a* and 215*b*, and a bypass control unit 216*a*.

The DC power source 211 is a circuit to convert AC power supplied from the commercial power source 201 into DC power, e.g., an AC-to-DC converter.

The constant-current circuit 212 is a circuit to generate a constant current by using DC power supplied from the DC power source 211, e.g., a DC-to-DC converter. The constant current generated in the constant-current circuit 212 is supplied to the LEDs 202*a* and 202*b*.

The smoothing capacitor 213 is connected between output terminals of the constant-current circuit 212. The smoothing capacitor 213 is a capacitive element to smoothen the constant current generated by the constant-current circuit 212.

Although the smoothing capacitor 213 is disposed outside the constant-current circuit 212 in FIG. 3, it may be incorporated in the constant-current circuit 212.

The detection circuit 214*a* detects whether the LED 202*a* is open-circuited. In other words, the detection circuit 214*a* detects whether the LED 202*a* has an open-circuit failure. Likewise, the detection circuit 214*b* detects whether the LED 202*b* is open-circuited, i.e., whether the LED 202*b* has an open-circuit failure.

The bypass circuit 215*a* is connected in parallel to the LED 202*a* and is for bypassing the LED 202*a*. For example, the bypass circuit 215*a* includes a switching element connected in parallel to the LED 202*a*. When the bypass circuit 215*a* is turned on, two ends of the LED 202*a* are short-circuited.

Likewise, the bypass circuit 215*b* is connected in parallel to the LED 202*b* and is for bypassing the LED 202*b*. For example, the bypass circuit 215*b* includes a switching element connected in parallel to the LED 202*b*. When the bypass circuit 215*b* is turned on, two ends of the LED 202*b* are short-circuited.

The bypass control unit 216*a* controls the bypass circuits 215*a* and 215*b* and the constant-current circuit 212 based on the results detected by the detection circuits 214*a* and 214*b*. Specifically, the bypass control unit 216*a* turns on the bypass circuit 215*a* if the detection circuit 214*a* detects an open-circuit failure in the LED 202*a*. Further, the bypass control unit 216*a* turns on the bypass circuit 215*b* if the detection circuit 214*b* detects an open-circuit failure in the LED 202*b*. Furthermore, if an open-circuit failure has detected, the bypass control unit 216*a* interrupts the constant-current circuit 212 for a predetermined discharge period, and then turns on the bypass circuit 215*a* or 215*b*. By doing so, electric charges accumulated in the smoothing capacitor 213 are released during the discharge period.

Figure 4:
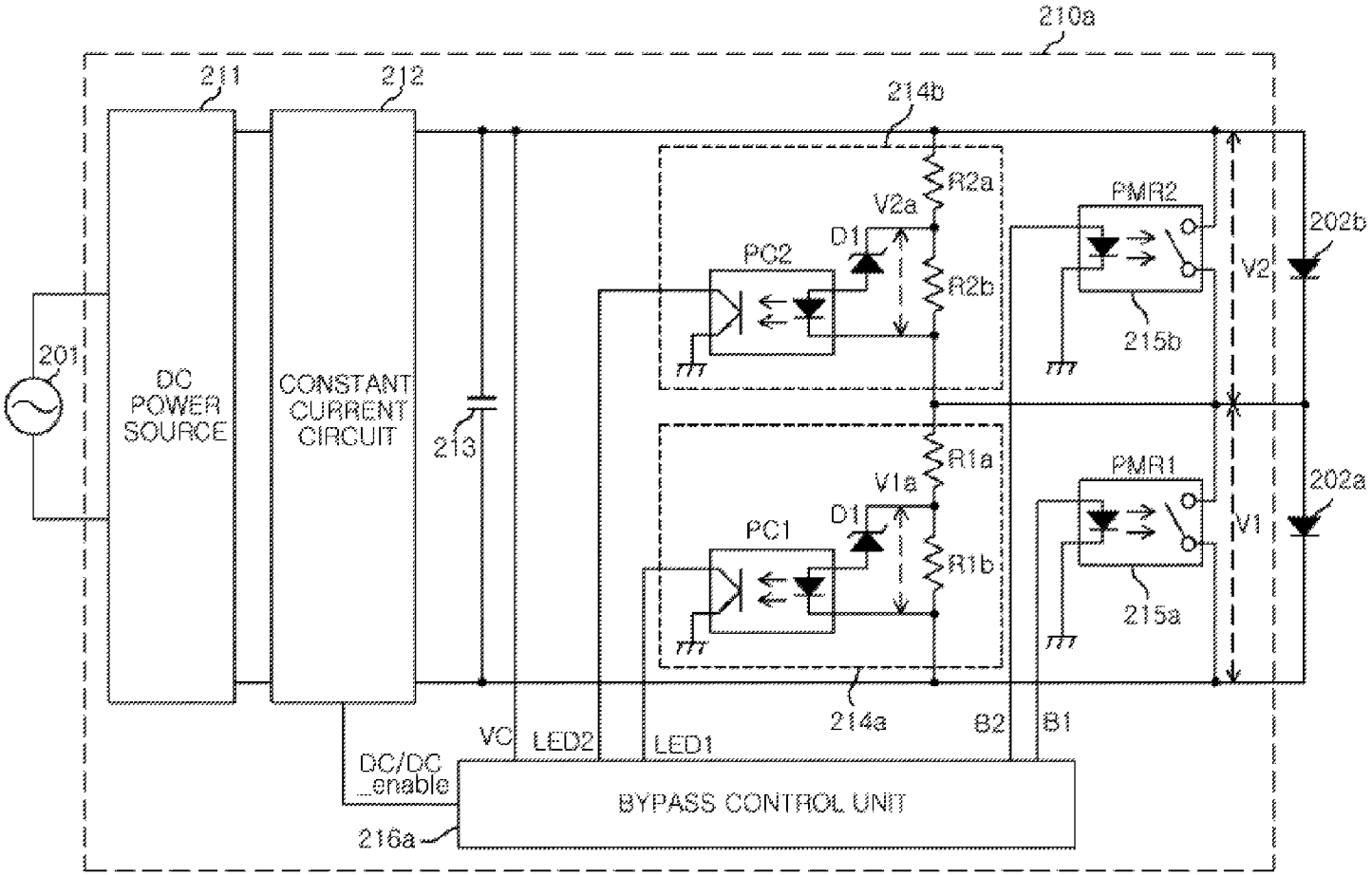
FIG. 4 is a circuit diagram showing a detailed configuration example of the lighting device according to the first embodiment.

FIG. 4 is a diagram of example circuits of the detection circuits 214*a* and 214*b* and the bypass circuits 215*a* and 215*b*.

The detection circuit 214*a* detects whether a voltage difference V1 across the LED 202*a* rise above a predetermined voltage Vf_max, and outputs a failure detection signal LED1 indicating a result of the detection. The voltage Vf_max is equal to the maximum of the forward voltage of the LEDs 202*a* and 202*b*, for example.

The detection circuit 214*a* includes voltage-dividing resistors R1*a* and R1*b*, a zener diode D1, and a photo-coupler PC1. The voltage-dividing resistors R1*a* and R1*b* generate a voltage V1*a* by dividing the voltage V1. If the voltage V1*a* rises above a voltage Vf_max_a corresponding to the voltage Vf_max, the zener diode D1 is turned on. Accordingly, current flows in the photo-coupler PC1 so that the level of the failure detection signal LED1 is changed to be low.

Likewise, the detection circuit 214*b* detects whether a voltage difference V2 across the LED 202*b* rises above the predetermined voltage Vf_max, and outputs a failure detection signal LED2 indicating a result of the detection. The detection circuit 214*b* includes voltage-dividing resistors R2*a* and R2*b*, a zener diode D2, and a photo-coupler PC2. The voltage-dividing resistors R2*a* and R2*b* generate a voltage V2*a* by dividing the voltage V2. If the voltage V2*a* rises above the voltage Vf_max_a corresponding to the voltage Vf_max, the zener diode D2 is turned on. Accordingly, current flows in the photo-coupler PC2 so that the level of the failure detection signal LED2 is changed to be low.

The bypass circuit 215*a* includes a photo MOS relay PMR1. The photo MOS relay PMR1 is turned on if the level of a bypass control signal B1 is high. Likewise, the bypass circuit 215*b* includes a photo MOS relay PMR2. The photo MOS relay PMR2 is turned on if the level of a bypass control signal B2 is high.

Figure 5:
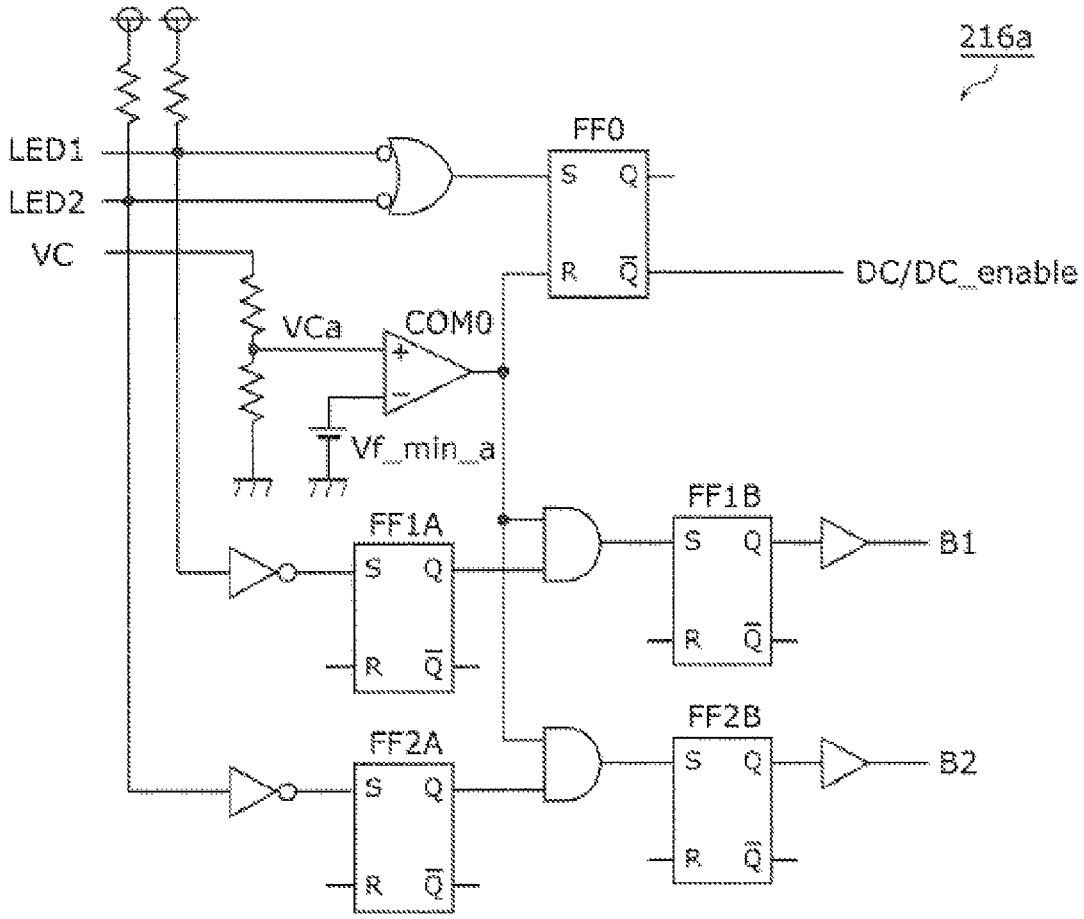
FIG. 5 is a circuit diagram showing a configuration example of a bypass control unit according to the first embodiment.

FIG. 5 shows an example of a circuit diagram of the bypass control unit 216*a*. As shown in FIG. 5, the bypass control unit 216*a* includes flip-flops FF0, FF1A, FF1B, FF2A and FF2B, and a comparator COM0.

The comparator COM0 compares a voltage VCa, obtained by dividing the voltage VC, with a reference voltage Vf_min_a corresponding to a reference voltage Vf_min.

The flip-flop FF0 outputs a stop control signal DC/DC_enable of low level when the level of the failure detection signal LED1 or LED2 becomes low. In addition, the flip-flop FF0 outputs a stop control signal DC/DC_enable of high level in response to an output signal from the comparator COM0 when the voltage VCa becomes lower than the reference voltage Vf_min_a.

After the level of the failure detection signal LED1 has become low, the flip-flop FF1B outputs a bypass control signal B1 of high level in response to an output signal from the comparator COM0 when the voltage VCa becomes lower than the reference voltage Vf_min_a. After the level of the failure detection signal LED2 has become low, the flip-flop FF2B outputs a bypass control signal B2 of high level in response to an output signal from the comparator COM0 when the voltage VCa becomes lower than the reference voltage Vf_min_a.

Figure 6:
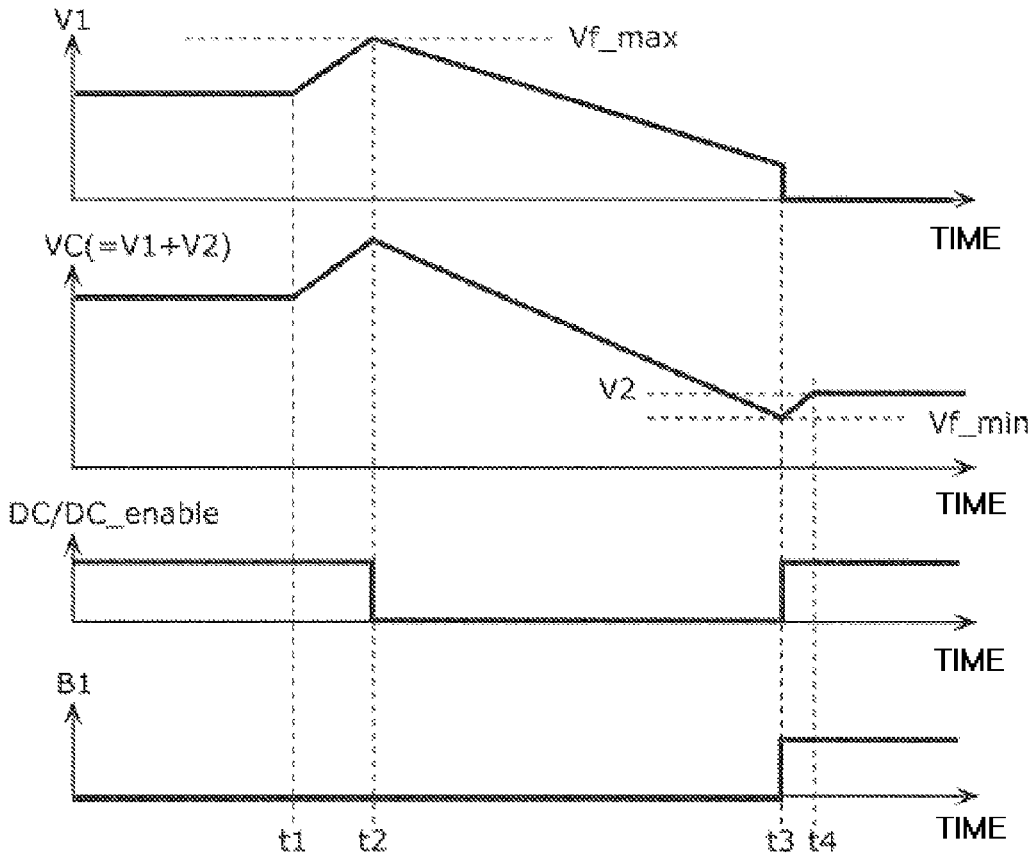
FIG. 6 is a timing chart of the lighting device according to the first embodiment.

FIG. 6 is a timing chart when the LED 202*a* has an open-circuit failure. Hereinafter, operations when the LED 202*a* has an open-circuit failure will be described.

Before time t1 at which the open-circuit failure occurs, the voltage V1 across the LED 202*a* is equal to the forward voltage Vf of the LED 202*a*. In addition, the voltage VC (=V1+V2) is equal to the sum (2×Vf) of the forward voltages Vf of the LEDs 202*a* and 202*b*.

At time t1, the open-circuit failure occurs in the LED 202*a*. At this time, the constant-current circuit 212 keeps supplying current, and thus the voltage VC increases. In addition, the voltage V2 across the normal LED 202*b* does not increase any further once it has reached the forward voltage Vf, and thus the voltage V2 stays at the forward voltage Vf. Accordingly, the voltage V1 increases as the voltage VC increases. As the voltage V1 increases, so does the voltage V1*a* that is obtained by dividing the voltage V1.

At time t2, when the voltage V1*a* reaches the voltage Vf_max_a (when the voltage V1 reaches the voltage Vf_max), the zener diode D1 is turned on. Accordingly, current flows in the photo-coupler PC1 so that the photo-coupler PC1 is turned on. As a result, the level of the failure detection signal LED1 becomes low, so that the open-circuit failure in the LED 202*a* is detected.

When the open-circuit failure is detected, a high-level signal is inputted to the set terminal of the flip-flop FF0. Accordingly, the level of the stop control signal DC/DC_enable becomes low. As the stop control signal DC/DC_enable becomes low, the constant-current circuit 212 stops its operation.

As the constant-current circuit 212 stops its operation, electric charges accumulated in the smoothing capacitor 213 are released through, e.g., the resistors R2*a*, R2*b*, R1*a* and R1*b*. Accordingly, the voltage VC decreases.

At time t3, if the voltage VC becomes lower than the voltage Vf_min, the level of the stop control signal DC/DC_enable becomes high. Specifically, if the voltage VC decreases, so does the voltage VCa that is inputted to the comparator COM0. Then, if the voltage VCa becomes lower than the voltage Vf_min_a corresponding to the voltage Vf_min, the level of the output signal from the comparator COM0 becomes high. Accordingly, the level of the stop control signal DC/DC_enable becomes high.

As the level of the stop control signal DC/DC_enable becomes high, the constant-current circuit 212 starts its operation.

In addition, as the level of the bypass control signal B1 becomes high, the bypass circuit 215*a* is turned on. Specifically, a high-level signal is inputted to the set terminal of the flip-flop FF1B. Accordingly, the level of the bypass control signal B1 becomes high, and thus the photo MOS relay PMR1 is turned on.

If the constant-current circuit 212 starts its operation, the voltage VC increases. At time t4, the voltage VC reaches a voltage equal to the forward voltage Vf of the normal LED 202*b*, so that current flows in the normal LED 202*b*. In other words, the LED 202*b* is lit.

As described above, if an open-circuit failure occurs in the LED 202*a*, the bypass circuit 215*a* is turned on, and accordingly the current supplied from the constant-current circuit 212 flows in the normal LED 202*b*, passing through the bypass circuit 215*a*. In this manner, even if one of the LEDs has an open-circuit failure, the other normal LEDs can be supplied with current.

Further, according to the first embodiment, when the bypass circuit 215*a* is turned on, electric charges in the smoothing capacitor 213 are released. By doing so, it is possible to suppress excessive current from flowing in the bypass circuit 215*a* and the LED 202*b*. Therefore, it is possible to suppress deterioration or failure of the LED 202*b* and malfunction of the bypass circuit 215*b*.

Although the operations when the LED 202*a* has an open-circuit failure have been described in the foregoing description, the operations can be equally applied to the case where the LED 202*b* has an open-circuit failure.

Further, although the two LEDs connected in series have been used in the foregoing description, three or more LEDs connected in series may be used. In the latter instance, the above-described detection circuit and the bypass circuit are provided for each of the LEDs.

Furthermore, although each of the LEDs includes the detection circuit and the bypass circuit in the foregoing description, at least one of the LEDs may include the detection circuit and the bypass circuit.

As described above, in the lighting device 210*a* according to the first embodiment, the constant-current circuit 212 resumes its operation when the voltage VC becomes lower than the voltage Vf_min. As shown in FIG. 6, the voltage Vf_min is, e.g., lower than the sum of the forward voltages of the normal LEDs (the forward voltage Vf of the LED 202*b* in the example of FIG. 6). However, the voltage Vf_min may be higher than the sum of the forward voltages of the normal LEDs. By way of providing a predetermined discharge period, the voltage VC of when the bypass circuit is turned on can be more lowered, compared to the case where no discharge period is provided. Accordingly, currents flowing in the normal LEDs at the time when the bypass circuit is turned on can be reduced, so that deterioration or failure of the normal LEDs can be suppressed.

Moreover, by providing a longer discharge period (by setting the voltage Vf_min to be lower), this effect can be enhanced. Therefore, it is preferable that the voltage Vf_min is lower than the voltage VC in a normal operation state with no open-circuit failure, for example. Herein, the voltage VC in a normal operation state refers to the sum of the forward voltages of LEDs (2×Vf in the example of FIG. 6) in a state with no open-circuit failure. Further, as shown in FIG. 6, it is desirable that the voltage Vf_min is the sum of the forward voltages of the normal LEDs other than the LED having an open-circuit failure.

In the foregoing description, the constant-current circuit 212 stops during the discharge period until the bypass circuit is turned on. However, the output from the constant-current circuit may be lowered than usual, e.g., up to a level at which the smoothing capacitor 213 is discharged. Also in this manner, the voltage VC can be reduced during the discharge period.

As described above, the lighting device 210*a* according to the first embodiment includes: the constant-current circuit 212 that supplies a constant current to the plurality of LEDs 202*a* and 202*b* connected in series, the smoothing capacitor 213 connected between output terminals of the constant-current circuit 212; the bypass circuits 215*a* or 215*b* connected in parallel to one of the LEDs 202*a* and 202*b* so as to bypass the one LED 202*a* (or 202*b*); the detection unit (detection circuit 214*a* or 214*b*) configured to detect whether the one LED 202*a* (or 202*b*) is open-circuited; the bypass control unit 216*a* configured to, when the detection circuit 214*a* (or 214*b*) detects that the one LED 202*a* (or 202*b*) is open-circuited, discharge the smoothing capacitor 213 during the discharge period to then bypass the one LED 202*a* (or 202*b*) through the bypass circuit 215*a* (or 215*b*).

With this configuration, when an open-circuit failure occurs in the LED 202*a*, the lighting device 210*a* releases electric charges accumulated in the smoothing capacitor 213 and then turns on the bypass circuit 215*a*. By doing so, it is possible to suppress excessive current flowing in normal LEDs when the bypass circuit 215*a* is turned on.

Specifically, during the discharge period, the bypass control unit 216*a* may stop the constant-current circuit 212 or may reduce a value of the constant current supplied from the constant-current circuit 212.

By doing so, the lighting device 210*a* can discharge the smoothing capacitor 213 during the discharge period.

In addition, during the discharge period, the smoothing capacitor 213 may be discharged until the voltage at the smoothing capacitor 213 becomes smaller than the sum of the forward voltages of the LEDs 202*a* and 202*b*. In addition, during the discharge period, the smoothing capacitor 213 may be discharged until the voltage at the smoothing capacitor 213 becomes smaller than the forward voltage of the LED 202*b* other than the LED 202*a* among the LEDs 202*a* and 202*b*.

In this manner, the lighting device 210*a* can further discharge the smoothing capacitor 213, so that it is possible to further suppress current flowing in the normal LED 202*b* when the bypass circuit 215*a* is turned on.

Additionally, the bypass control unit 216*a* may include the comparator COM0 to compare the voltage VC at the smoothing capacitor 213 with the reference voltage Vf_min, and may terminate the discharge period when the voltage VC at the smoothing capacitor 213 becomes smaller than the reference voltage Vf_min and may bypass the LED 202*a* through the bypass circuit 215*a*.

By doing so, the lighting device 210*a* may turn on the bypass circuit 215*a* after the voltage VC has decreased up to a predetermined voltage.

Second Embodiment

The second embodiment to be described below is a modification of the first embodiment. In addition to the elements of the first embodiment, the lighting device 210*b* according to the second embodiment further includes a discharge circuit for discharging electric charges in the smoothing capacitor 213 during the discharge period.

In the following description, descriptions will be made focusing on differences between the first and second embodiments, and redundant descriptions on the same elements will be omitted.

Figure 7:
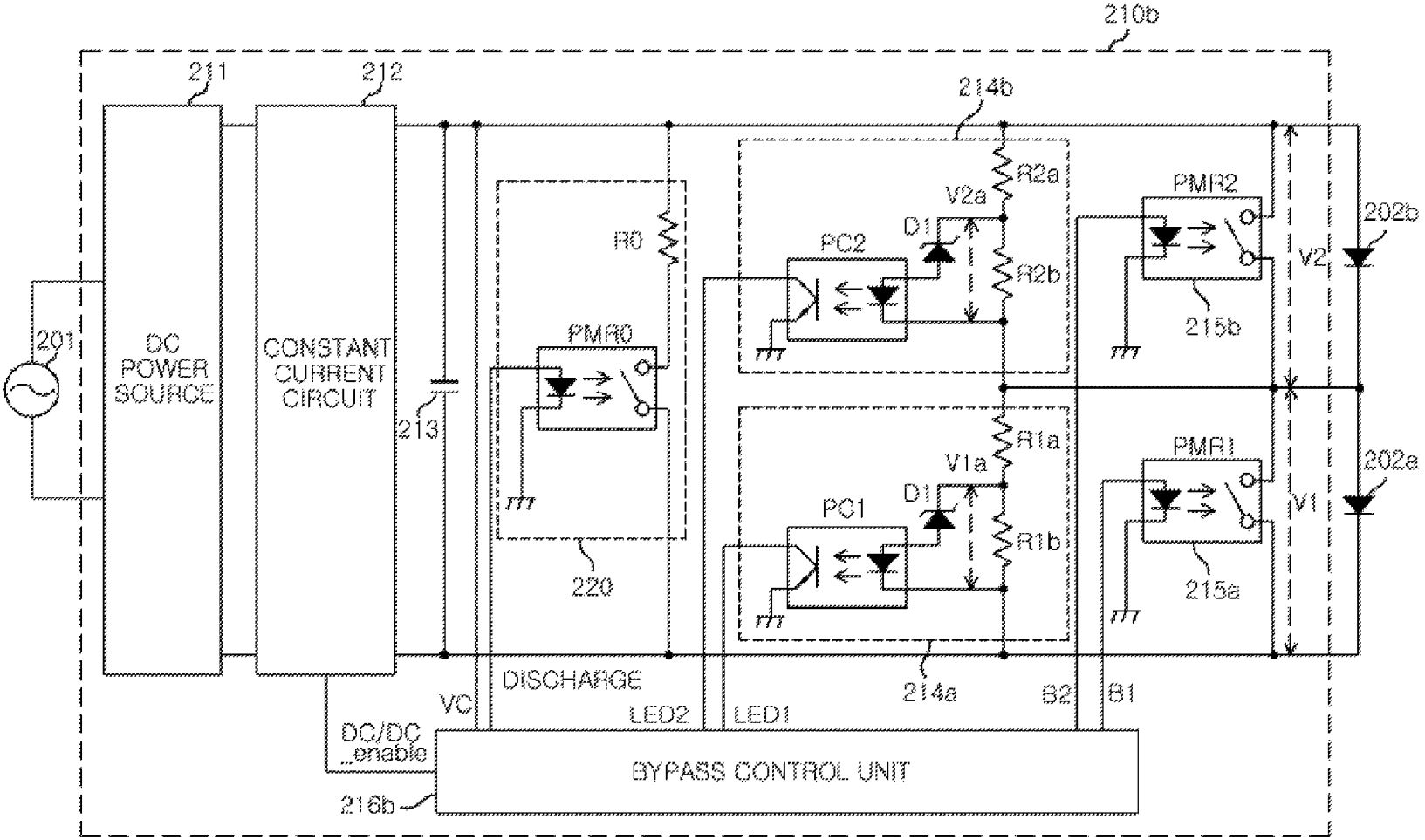
FIG. 7 is a circuit diagram showing a configuration example of a lighting device according to a second embodiment.

FIG. 7 is a circuit diagram of a lighting device 210*b* according to the second embodiment of the present invention. In addition to the elements shown in FIG. 3, the lighting device 210*b* shown in FIG. 7 further includes a discharge circuit 220. The bypass control unit 216*b* includes the functionality of the bypass control unit 216*a*.

The discharge circuit 220 is connected in parallel to the smoothing capacitor 213 and includes a switching element connected in parallel to the smoothing capacitor 213. For example, the discharge circuit 220 includes a photo MOS relay PMR0 and a resistor R0. As the photo MOS relay PMR0 is turned on, electric charges accumulated in the smoothing capacitor 213 are released through the resistor R0 and the photo MOS relay PMR0.

Figure 8:
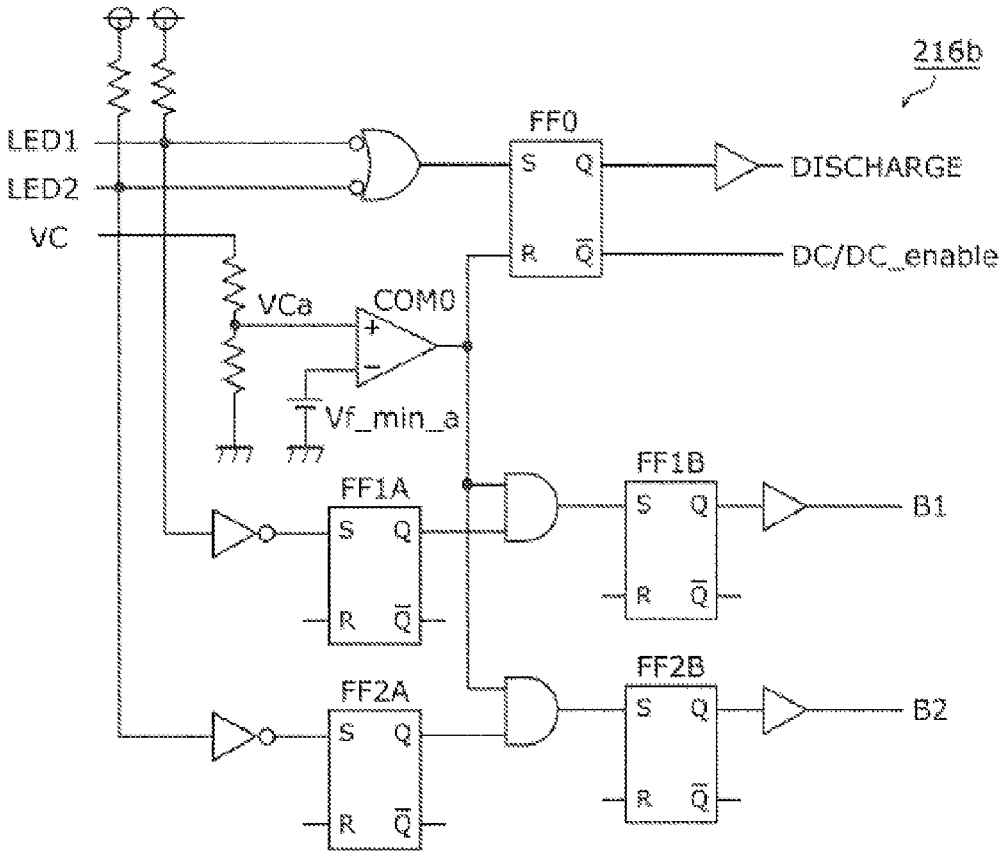
FIG. 8 is a circuit diagram showing a configuration example of a bypass control unit according to the second embodiment.

In addition to the functionality of the bypass control unit 216*a*, the bypass control unit 216*b* has the functionality of turning on the discharge circuit 220 during a discharge period. FIG. 8 shows an example of a circuit diagram of the bypass control unit 216*b*. As shown in FIG. 8, the bypass control unit 216*b* outputs a discharge control signal DISCHARGE that is an inverted signal of the stop control signal DC/DC_enable, in addition to the functionality of the bypass control unit 216*a*.

Figure 9:
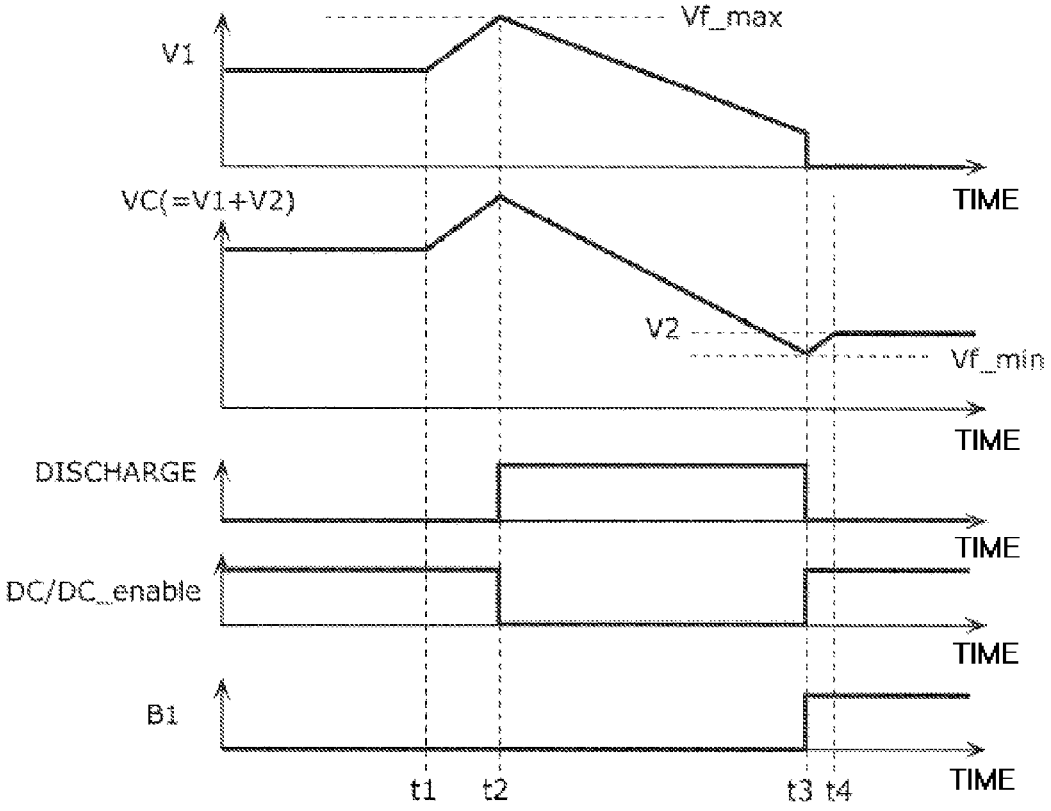
FIG. 9 is a timing chart of the lighting device according to the second embodiment.

FIG. 9 is a timing chart when the LED 202*a* has an open-circuit failure in the lighting device 210*b* according to the second embodiment.

As shown in FIG. 9, at time t2, if the voltage V1 reaches the voltage Vf_max, the level of the discharge control signal DISCHARGE becomes high. In response to this, the photo MOS relay PMR0 is turned on, and accordingly electric charges accumulated in the smoothing capacitor 213 are released through the resistor R0 and the photo MOS relay PMR0.

By employing the discharge circuit 220 in this manner, the discharge period (from time t2 to time t3) can be more shortened than that of the first embodiment.

Figure 10:
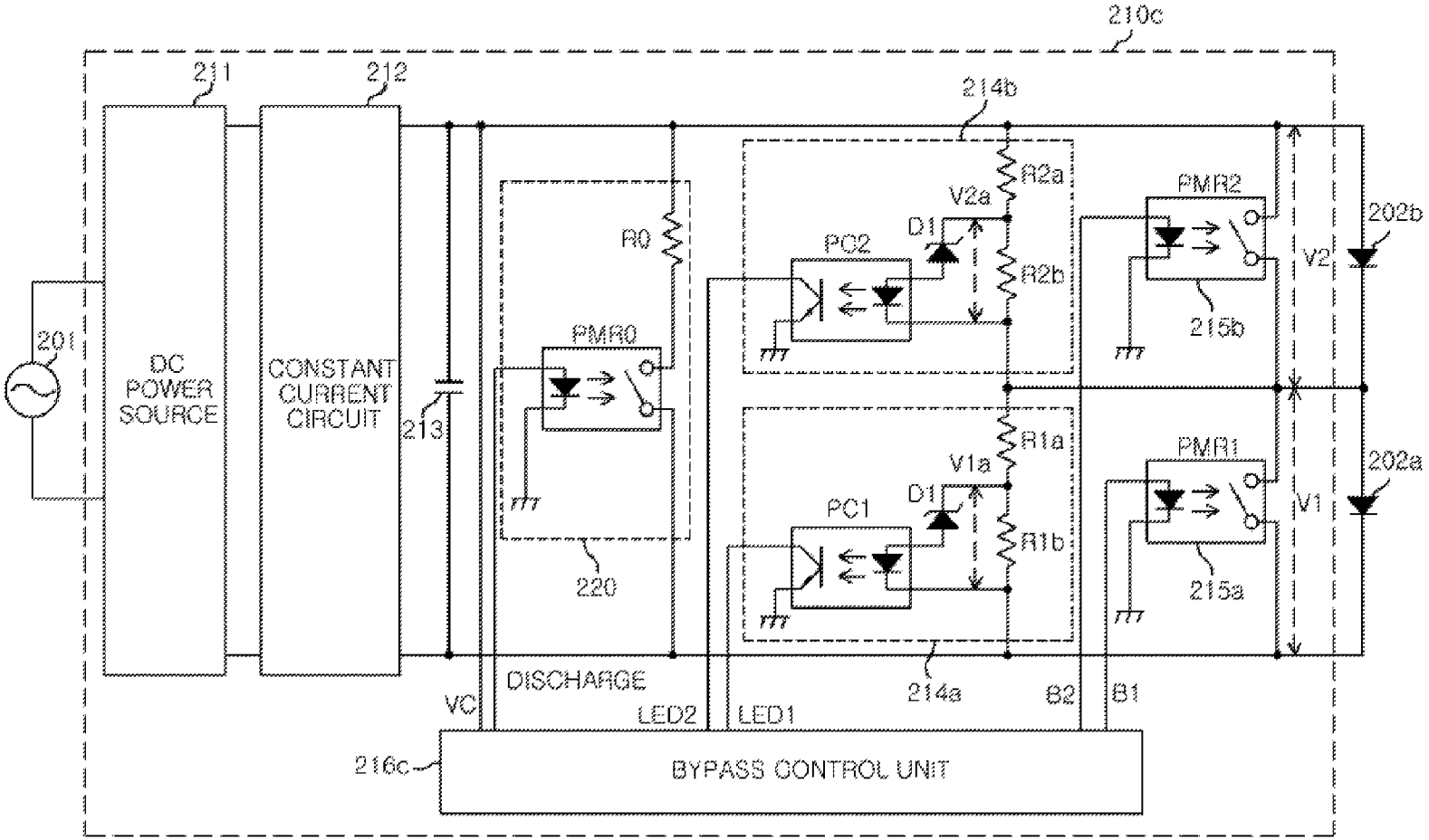
FIG. 10 is a circuit diagram showing a configuration example of a lighting device according to a modification of the second embodiment.
Figure 11:
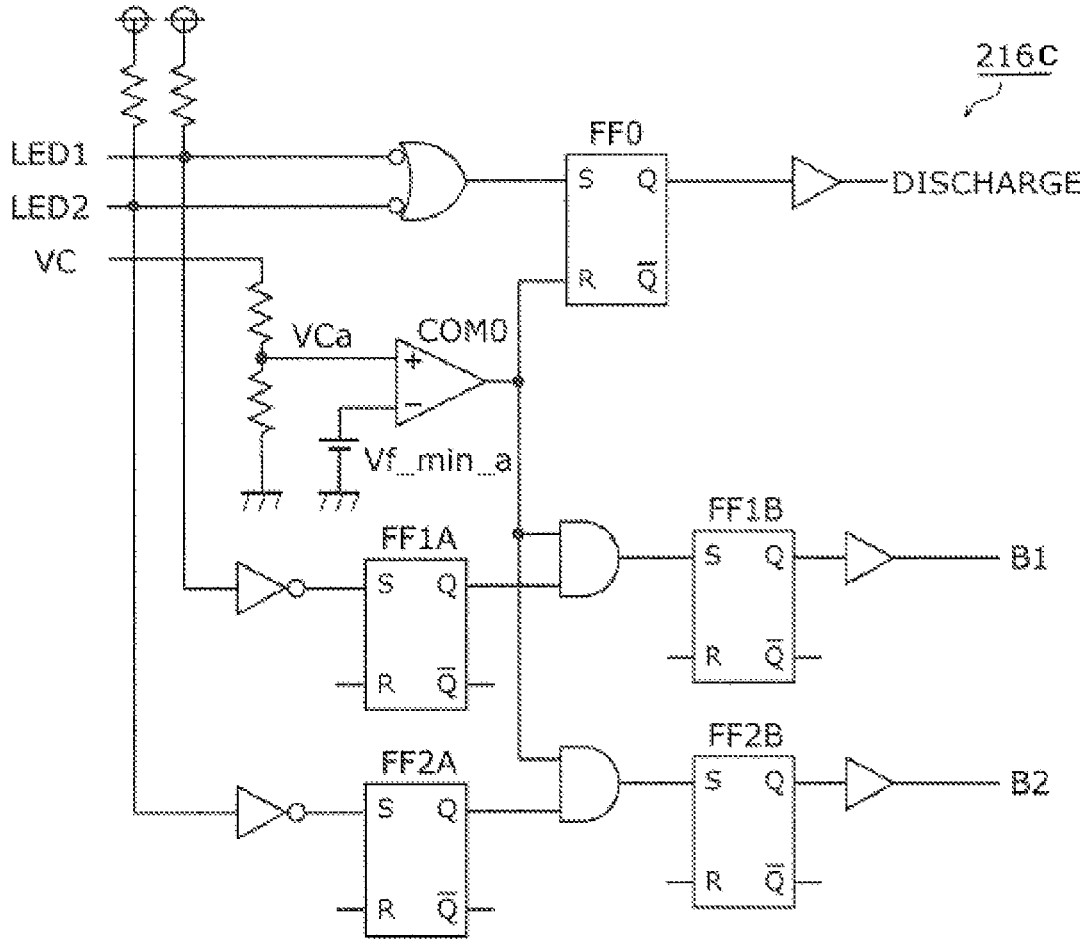
FIG. 11 is a circuit diagram showing a configuration example of a bypass control unit according to the modification of the second embodiment.

Herein, the constant-current circuit 212 stops and the discharge circuit 220 is turned on during the discharge period. However, the constant-current circuit 212 may not stop. FIG. 10 shows a circuit diagram of a lighting device 210*c* according to this instance. The configuration shown in FIG. 10 is identical to that of FIG. 7 except that the bypass control unit 216*c* does not output the stop control signal DC/DC_enable. FIG. 11 shows an example of a circuit diagram of the bypass control unit 216*c*.

As such, even if the constant-current circuit 212 does not stop, the smoothing capacitor 213 is discharged through the discharge circuit 220, and therefore the same effect as the above can be achieved.

As described above, the lighting devices 210*b* and 210*c* may further include the discharge circuit 220 connected in parallel to the smoothing capacitor 213, and the bypass control unit 216*b* or 216*c* may turn on the discharge circuit 220 during the discharge period to discharge the smoothing capacitor 213.

By doing so, the smoothing capacitor 213 can be discharged during the discharge period.

Third Embodiment

In the above embodiments, the discharge period terminates when the voltage VC becomes lower than the predetermined voltage Vf_min. According to the third embodiment, the discharge period terminates after a predetermined time period has elapsed from the start of the discharge period.

Figure 12:
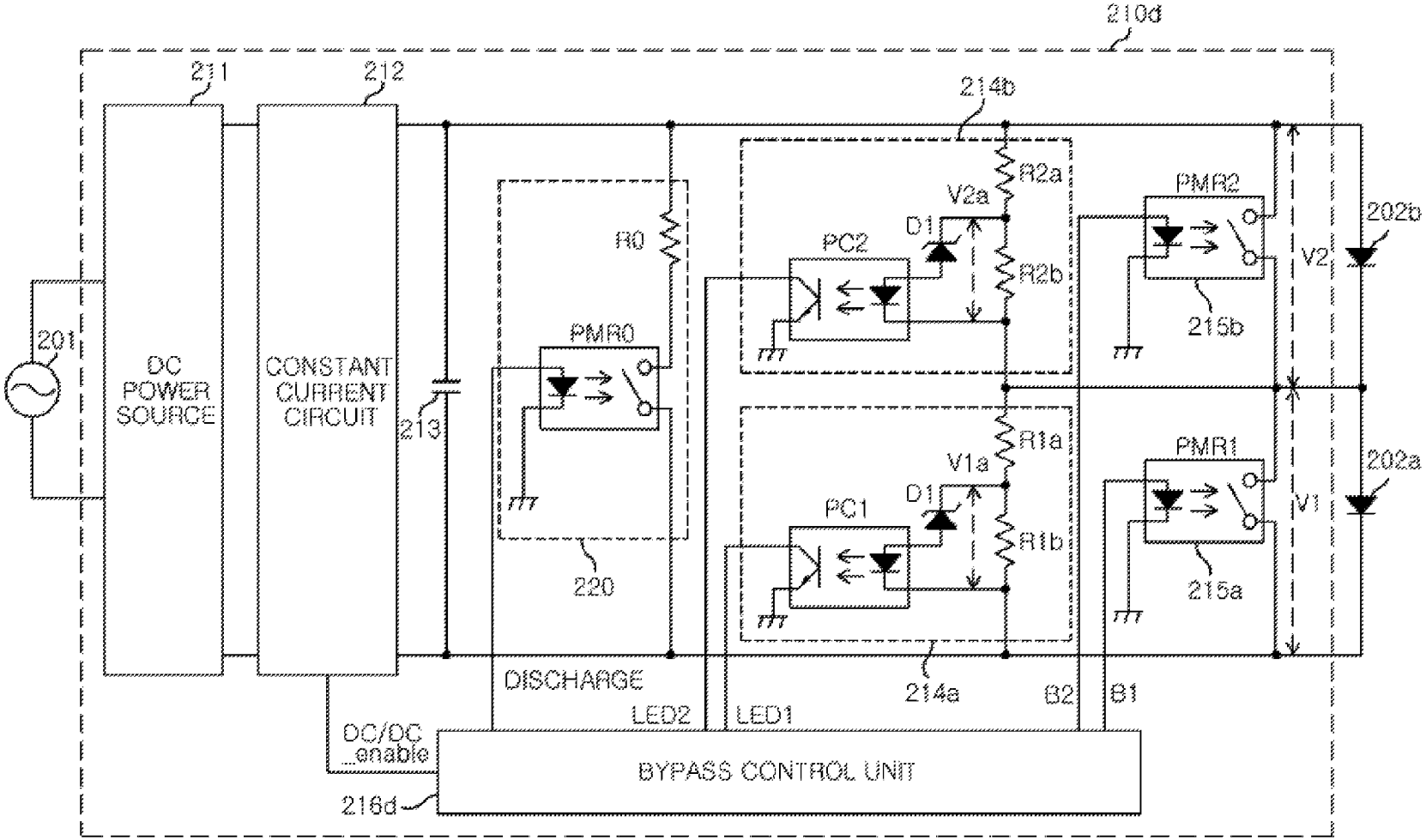
FIG. 12 is a circuit diagram showing a configuration example of a lighting device according to a third embodiment.

FIG. 12 is a circuit diagram of a lighting device 210*d* according to the third embodiment of the present invention. The configuration of the lighting device 210*d* shown in FIG. 12 is identical to that of FIG. 7 except that the configuration of a bypass control unit 216*d* is different from that of the bypass control unit 216*b*. As in the configuration shown in FIG. 7, the configuration in which the discharge circuit 220 is employed and the constant-current circuit 212 stops during the discharge period will be described as an example in this embodiment. However, the discharge circuit 220 may not be employed or the constant-current circuit 212 may not stop during the discharge period.

Figure 13:
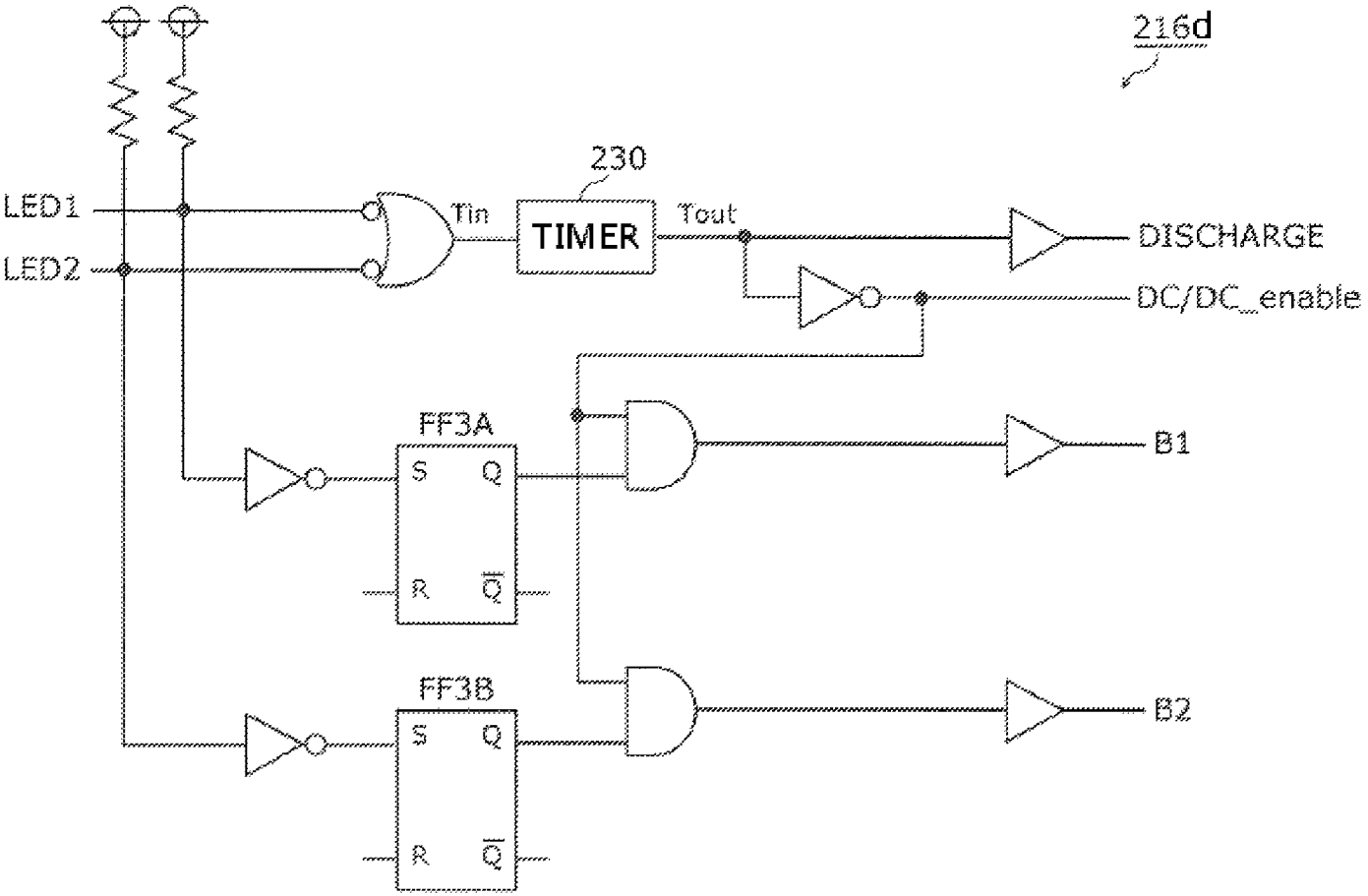
FIG. 13 is a circuit diagram showing a configuration example of a bypass control unit according to the third embodiment.

The bypass control unit 216*d* terminates the discharge period after a predetermined time period has elapsed from the start of the discharge period. FIG. 13 shows an example of a circuit diagram of the bypass control unit 216*d*. As shown in FIG. 13, the bypass control unit 216*d* includes a timer 230, and flip-flops FF3A and FF3B.

The timer 230 outputs a discharge control signal DISCHARGE of high level and a stop control signal DC/DC_enable of low level for a predetermined time period after the level of a failure detection signal LED1 or LED2 has become low. Further, the timer 230 outputs the discharge control signal DISCHARGE of low level and the stop control signal DC/DC_enable of high level after the predetermined time period has elapsed.

After the level of the failure detection signal LED1 becomes low, the flip-flop FF3A outputs a bypass control signal B1 of high level if the level of the stop control signal DC/DC_enable is high. After the level of the failure detection signal LED2 becomes low, the flip-flop FF3B outputs a bypass control signal B2 of high level if the level of the stop control signal DC/DC_enable is high.

Figure 14:
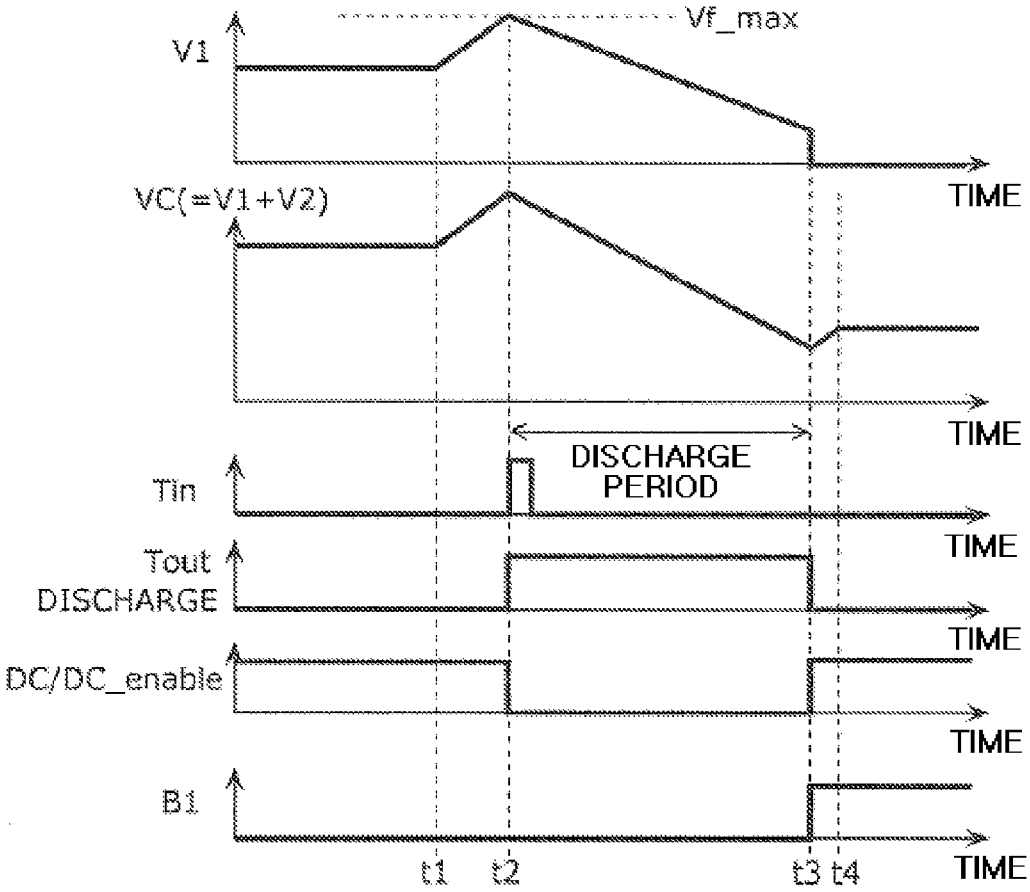
FIG. 14 is a timing chart of the lighting device according to the third embodiment.

FIG. 14 is a timing chart when the LED 202*a* has an open-circuit failure in the lighting device 210*d* according to the third embodiment. As shown in FIG. 14, at time t2, when the voltage V1 reaches the voltage Vf_max, the level of an input signal Tin of the timer 230 becomes high. Then, the timer 230 outputs an output signal Tout of high level for a predetermined time period. Accordingly, for the predetermined time period, the level of the discharge control signal DISCHARGE is high and the level of the stop control signal DC/DC_enable is low. As a result, during the discharge period, the constant-current circuit 212 stops and the discharge circuit 220 is tuned on.

Figure 15A:
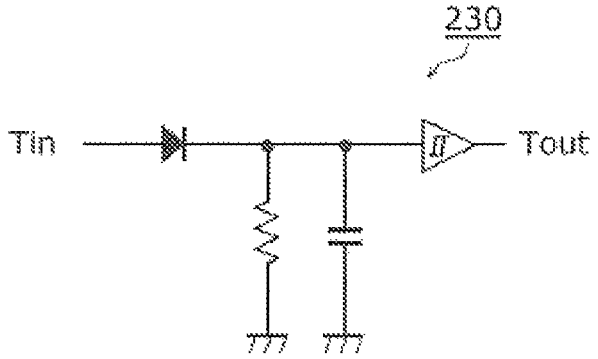
FIG. 15A is a circuit diagram showing a configuration example of a timer according to the third embodiment.
Figure 15B:
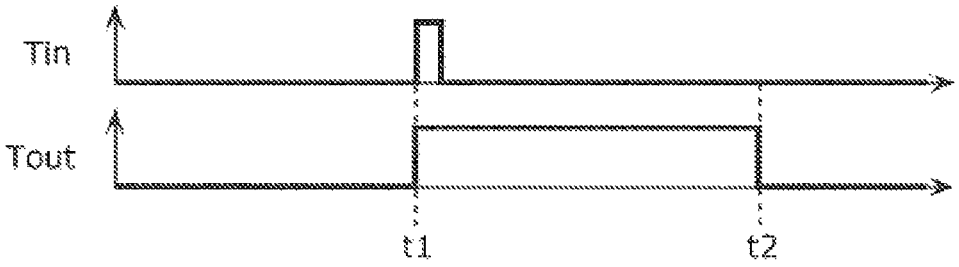
FIG. 15B is a timing chart of the timer according to the third embodiment.

FIG. 15A shows an example of a circuit diagram of the timer 230. FIG. 15B is a timing chart showing relationship between the input signal Tin and the output signal Tout of the timer 230. As can be seen from FIGS. 15A and 15B, when the level of the input signal Tin becomes high, the level of the output signal Tout also becomes high and then becomes low after a predetermined time period elapses.

Herein, the discharge period from when the level of the output signal Tout becomes high until it becomes low corresponds to the above-described discharge period. Therefore, it is desirable that the discharge period is set to be long enough so that the voltage VC becomes lower than the voltage Vf_min (e.g., the sum of the forward voltages of normal LEDs) when the discharge period terminates. For example, the discharge period is set to be longer than a time constant of a discharge path (the discharge circuit 220, in this example) through which electric charges in the smoothing capacitor 213 are released during the discharge period. Further, as described above, the voltage VC may not be lowered than the sum of the forward voltages of normal LEDs when the discharge period terminates. Even though the voltage VC is not lowered enough, the voltage VC can be decreased when the bypass circuit is turned on. Therefore, it is possible to suppress excessive current from flowing in normal LEDs, compared to the case where no discharge period is provided.

As described above, after the detection circuit 214*a* detects that the LED 202*a* is open-circuited, the bypass control unit 216*d* may terminate the discharge period after a predetermined time period has elapsed and may bypass the LED 202*a* through the bypass circuit 215*a*.

Accordingly, the discharge period can be set as required.

Further, the discharge period may be longer than the time constant of the discharge path through which the smoothing capacitor 213 is discharged.

By doing so, electric charges in the smoothing capacitor 213 can be released sufficiently until the bypass circuit 215*a* is turned on.

Fourth Embodiment

According to the fourth embodiment, the same functionalities of the above embodiments are implemented by using an MCU (microcontroller).

Figure 16:
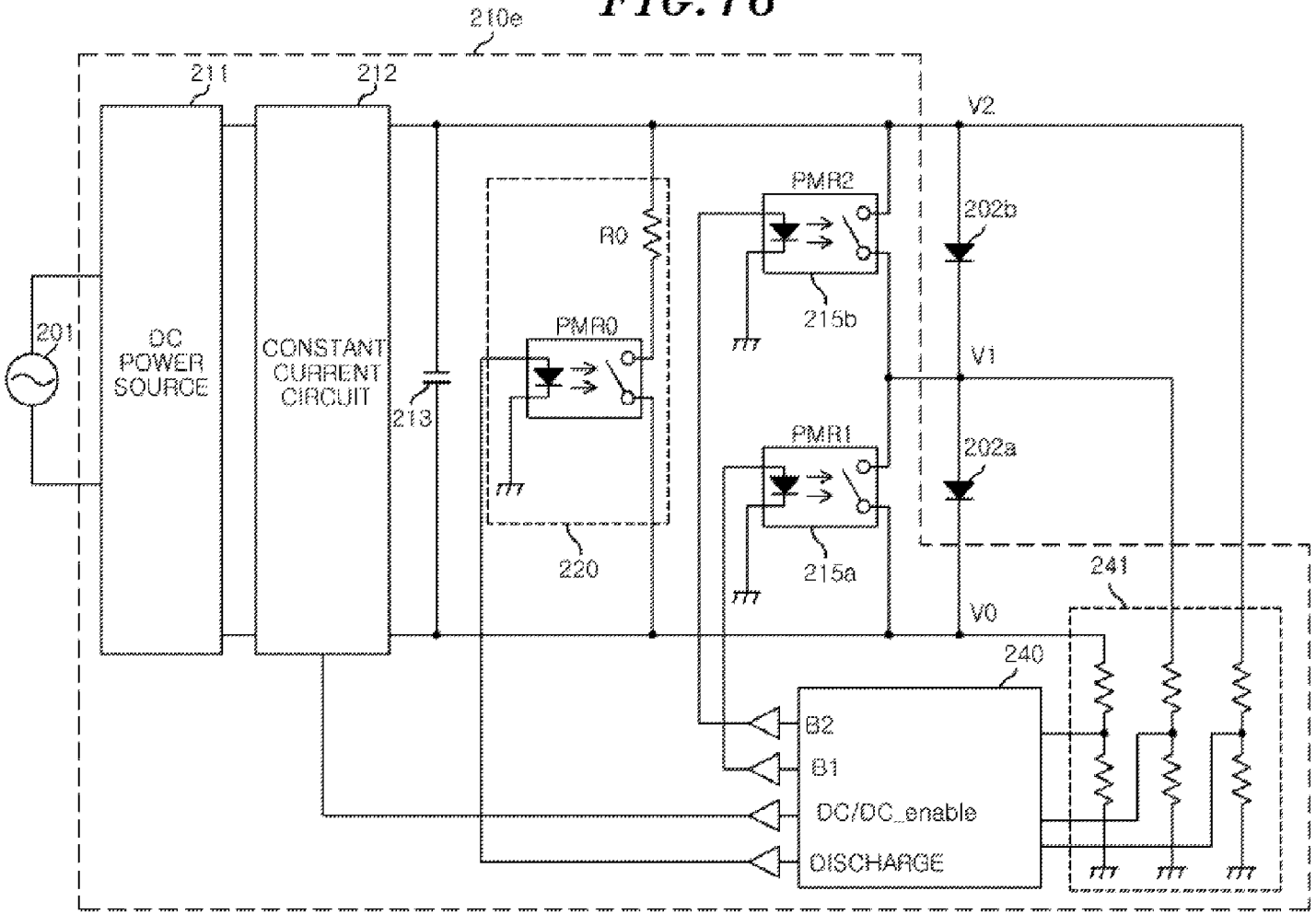
FIG. 16 is a circuit diagram showing a configuration example of a lighting device according to a fourth embodiment.

FIG. 16 is a circuit diagram of a lighting device 210*e* according to the fourth embodiment of the present invention. The configuration of the lighting device 210*e* shown in FIG. 16 is identical to that of FIG. 7 except that the lighting device 210*e* includes an MCU 240 and a group of voltage-dividing resistors 241, in place of the bypass control unit 216*b* and the detection circuits 214*a* and 214*b*. As in the configuration shown in FIG. 7, the discharge circuit 220 is employed and the constant-current circuit 212 stops during the discharge period in this embodiment. However, the discharge circuit 220 may not be employed or the constant-current circuit 212 may not stop during the discharge period.

By the MCU 240 and the group of voltage-dividing resistors 241, the same functionality as the above-described bypass control unit 216*b* and the detection circuits 214*a* and 214*b* is achieved.

As shown in FIG. 16, the group of voltage-dividing resistors 241 generates voltages V0*a*, V1*a* and V2*a* by dividing the voltages V0, V1 and V2, respectively.

The MCU 240 is a microcontroller and detects whether any of the LEDs 202*a* and 202*b* has an open-circuit failure by using the voltages V0*a*, V1*a* and V2*a*, in addition to the functionality of the bypass control unit 216*b*.

Figure 17A:
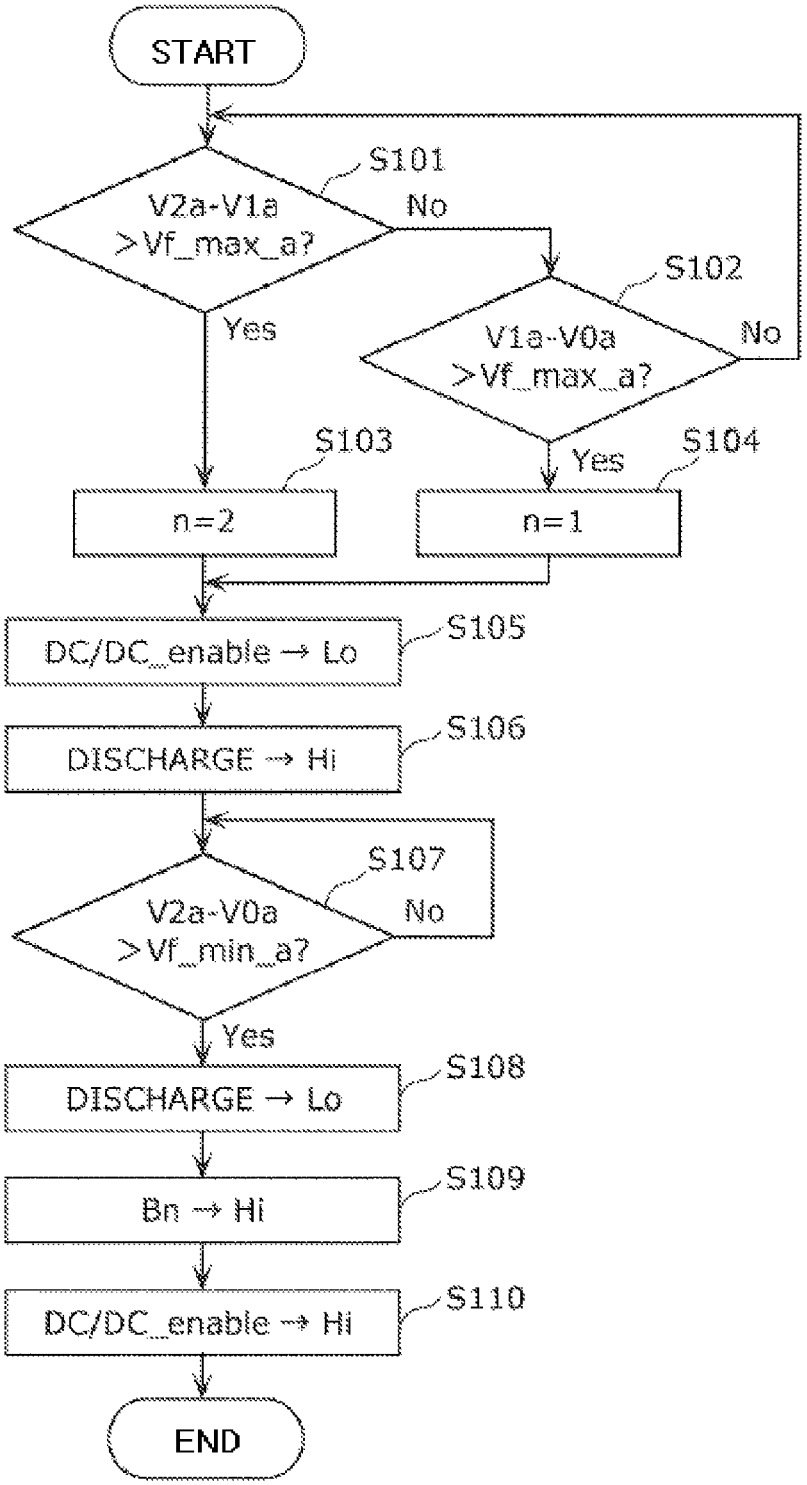
FIG. 17A is a flowchart for illustrating processes by in an MCU according to the fourth embodiment.

Hereinafter, the operation of the microcontroller will be described in detail. FIG. 17A is a flowchart for illustrating the operation of the MCU 240.

The MCU 240 includes an A/D converter that converts the voltages V0*a*, V1*a* and V2*a* into digital signals. The MCU 240 calculates differences in voltages, i.e., V2*a*−V1*a* and V1*a*−V0*a*, and determines whether each of the differences is greater than Vf_max_a (in step S101 and S102). By doing so, the MCU 240 determines whether each of the LEDs 202*a* and 202*b* has an open-circuit failure. The voltage Vf_max_a is a value corresponding to the voltage Vf_max (e.g., the maximum of the forward voltages of LEDs).

If the difference V2*a*−V1*a* is greater than the voltage Vf_max_a (Yes in step S101), the MCU 240 determines that the LED 202*b* has an open-circuit failure and sets a variable "n" to be "2" (in step S103). Further, if the difference V1*a*−V0*a* is greater than the voltage Vf_max_a (Yes in step S102), the MCU 240 determines that the LED 202*a* has an open-circuit failure and sets the variable "n" to be "1" (in step S104).

Subsequent to step S103 or S104, the MCU 240 sets the level of the stop control signal DC/DC_enable to be low (in step S105), and sets the level of the discharge control signal DISCHARGE to be high (in step S106). As a result, the constant-current circuit 212 stops and the discharge circuit 220 is tuned on.

Then, the voltage V2−V0 across the smoothing capacitor 213 decreases. The MCU 240 calculates the voltage V2*a*−V0*a*, and determines whether a result of the calculation is less than Vf_min_a (in step S107). The voltage Vf_min_a is a value corresponding to the voltage Vf_min (e.g., a value smaller than the sum of the forward voltages of normal LEDs).

If the voltage V2*a*−V0*a* is less than the voltage Vf_min_a (Yes in step S107), the MCU 240 sets the level of the discharge control signal DISCHARGE to be high to thereby turn off the discharge circuit 220.

Subsequently, the MCU 240 sets the level of a bypass control signal Bn (where n is a value (1 or 2) set in step S103 or S104) to be high to thereby turn on the bypass circuit 215*a* or 215*b* (in step S109). Namely, if the LED 202*a* has an open-circuit failure (n=1), the MCU 240 sets the level of the bypass control signal B1 to be high to thereby turn on the bypass circuit 215*a*. If the LED 202*b* has an open-circuit failure (n=2), the MCU 240 sets the level of the bypass control signal B2 to be high to thereby turn on the bypass circuit 215*b*.

Thereafter, the MCU 240 sets the level of the stop control signal DC/DC_enable to be high to thereby operate the constant-current circuit 212 (in step S110).

In the above-described manner, the same operations as those of the second embodiment are implemented.

Figure 17B:
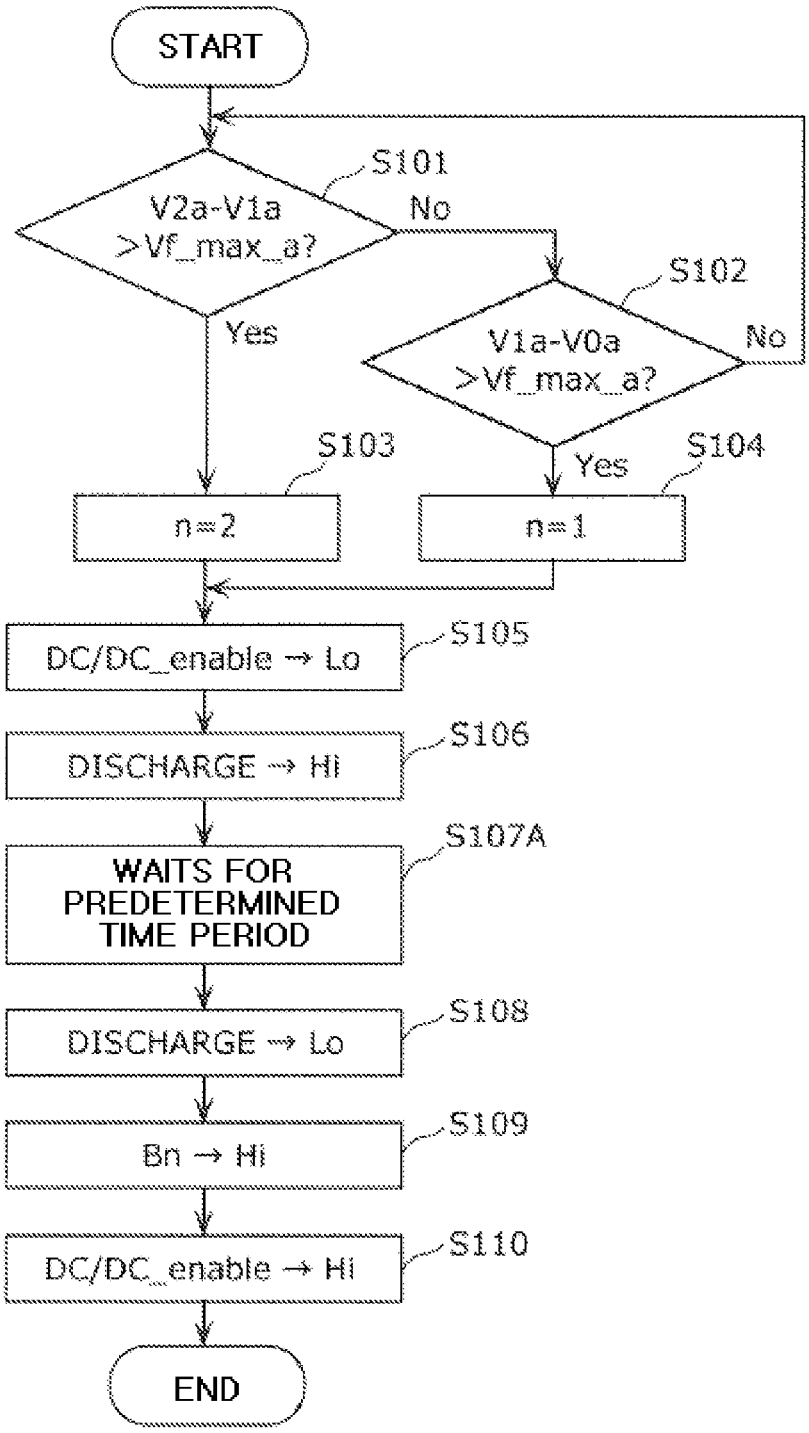
FIG. 17B is a flowchart for illustrating processes by in an MCU according to a modification of the fourth embodiment.

As in the third embodiment, the MCU 240 may end the discharge period after a predetermined time period has elapsed from the start of the discharge period. FIG. 17B is a flowchart for illustrating the operation of the MCU 240 in this instance. The processes illustrated in FIG. 17B are identical to those of FIG. 17A except that step S107 is replaced with step S107A.

Subsequent to step S106, the MCU 240 waits for a predetermined time period (discharge period) (in step S107A). Thereafter, the MCU 240 performs the processes of step S108 and subsequent steps.

Thus far, the lighting devices according to the embodiments have been described. However, the present invention is not limited to the above embodiments.

Figure 18:
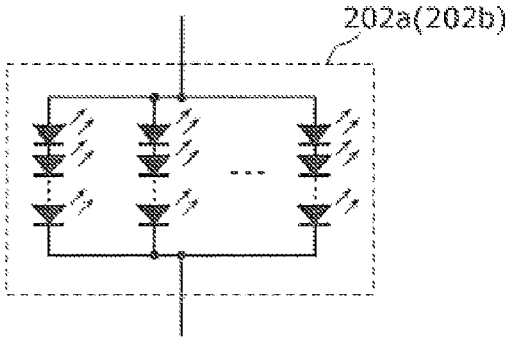
FIG. 18 is a circuit diagram showing a configuration example of light-emitting elements according to a modification of the embodiments.

For example, although one bypass circuit has been provided for one light-emitting element in the above embodiments, one bypass circuit may be provided for a plurality of light emitting elements. The light-emitting elements may be connected to one another either in parallel or in series. Further, as shown in FIG. 18, groups of light-emitting elements, each group having light-emitting elements connected in series, may be connected to one another in parallel. In other words, the light-emitting element may be a single LED or may include LEDs connected in series and/or in parallel. Further, the light-emitting element may be an LED module including a plurality of LED chips or may include a plurality of LED modules.

Although an LED has been used as the solid-state light-emitting element in the above embodiments, an organic EL (Electro-Luminescence) element may be used as the solid-state light-emitting element.

Further, in the above description, a photo MOS relay has been used as the switching element employed in the bypass circuit and the discharge circuit. However, an MOSFET (Metal Oxide Semiconductor Field Effect Transistor), a thyristor, a triac, a photo-coupler, a power transistor, an IGBT (Insulated Gate Bipolar Transistor), a relay, a bimetal or the like may be used as the switching element.

Further, different control may be conducted in a normal operation state (where no open-circuit failure occurs in light-emitting elements) and a bypass state in which the bypass circuit is turned on (after an open-circuit failure has occurred in a light-emitting element).

For example, when an open-circuit failure has occurred, a light-emitting element having the open-circuit failure is not lit, and thus a less number of light-emitting elements are lit in a bypass state. Therefore, the brightness degrades in the case where constant current is supplied. To cope with this, the constant-current circuit 212 may supply to the light-emitting element a larger current in the bypass state than in the normal operation state. By doing so, difference in optical power between the bypass state and the normal operation state can be reduced.

Further, the constant-current circuit 212 may intermittently supply current to the light-emitting elements in the bypass state. In this case, the light-emitting elements blink on and off in the bypass state, so that a user can notice that a light-emitting element has been open-circuited due to a failure or a bad connection of the light-emitting element.

The constant-current circuit (212) is, e.g., a DC-to-DC converter. Hereinafter, a specific example of the constant-current circuit 212 will be described.

Figure 19:
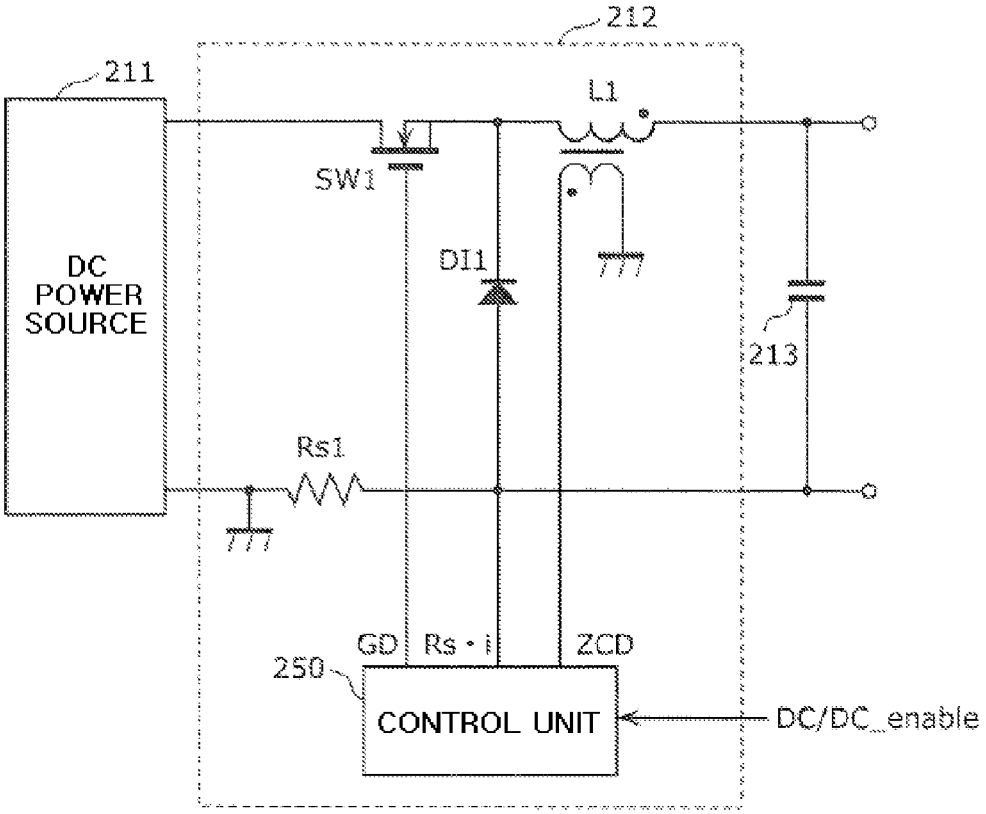
FIG. 19 is a circuit diagram showing a configuration example of a constant-current circuit according to the exemplary embodiments.

FIG. 19 is a circuit diagram showing a specific example of the constant-current circuit 212. The constant-current circuit 212 shown in FIG. 19 is of a step-down DC-to-DC converter, and includes a switching element SW1, an inductor L1, a diode DI1, a resistor Rs1, and a control unit 250. The smoothing capacitor 213 is disposed outside the constant-current circuit 212, but may be included in the constant-current circuit 212.

The switching element SW1 is connected in series to the DC power source 211 and is turned on and off by the control unit 250.

The inductor L1 is connected in series to the switching element SW1. When the switching element SW1 is turned on, current from the DC power source 211 flows in the inductor L1.

The diode DI1 is an element through which current discharged from the inductor L1 is supplied to the LEDs 202*a* and 202*b*.

The resistor Rs1 is to generate a voltage Rs·i that corresponds to a current flowing in the switching element SW1 (LEDs 202*a* and 202*b*).

The control unit 250 generates a signal GD to control on/off of the switching element SW1 based on a signal ZCD from a secondary winding of the inductor L1 and the voltage Rs·i. The signal ZCD is proportional to a time differential of a current flowing in the inductor L1 and is used to detect whether the current flowing in the inductor becomes zero.

Figure 20:
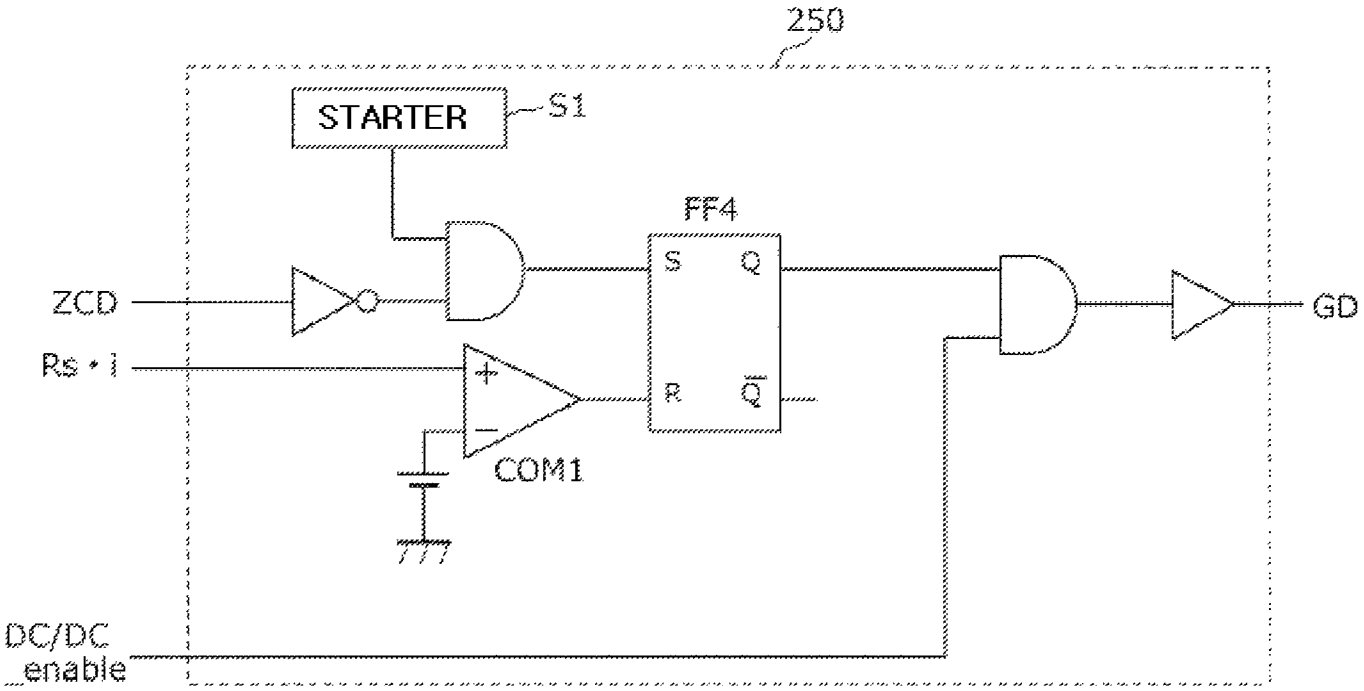
FIG. 20 is a circuit diagram showing a configuration example of a control unit according to the embodiments.

FIG. 20 is a circuit diagram of an example of the control unit 250. In order to start the constant-current circuit 212, a starter S1 generates a start pulse signal so that the level of the Q output (signal GD) of a flip-flop FF4 becomes high. As a result, the switching element SW1 is turned on.

As the switching element SW1 is turned on, current from the DC power source 211 flows in the switching element SW1, the inductor L1, the LED 202*a* and the LED 202*b*. This current increases over time. When this current reaches a peak current, the level of an output signal from a comparator COM1 becomes high, so that the level of the Q output (signal GD) of the flip-flop FF4 becomes low. As a result, the switching element SW1 is turned off.

When the switching element SW1 is turned off, the diode DI1 becomes conductive, so that current flows in the inductor L1 and the diode DI1. This current decreases from the peak current over time. When the current flowing in the inductor L1 becomes zero, the level of the signal ZCD becomes low. In response to this, the level of the Q output (signal GD) of the flop-flop FF4 becomes high, and accordingly the switching element SW1 is turned on again.

By repeating the above operations, the constant-current circuit 212 supplies constant current to the LEDs 202*a* and 202*b*.

Figure 21:
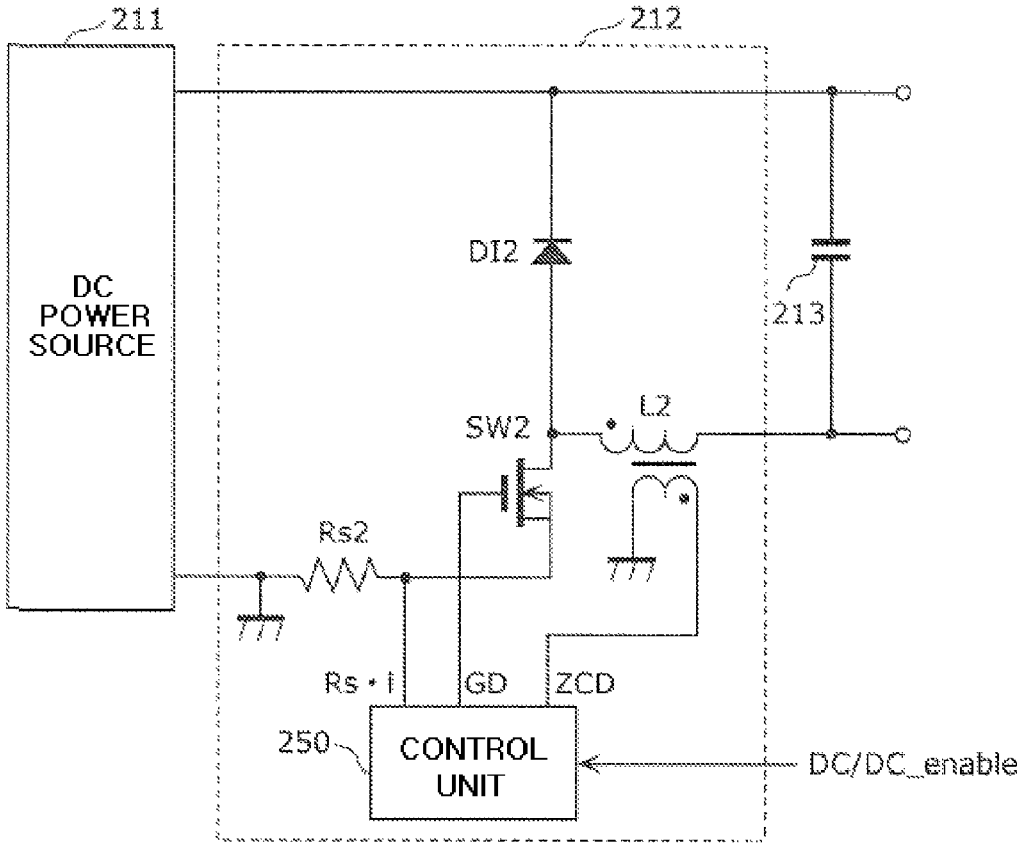
FIG. 21 is a circuit diagram showing another configuration example of a constant-current circuit according to the embodiments.
Figure 22:
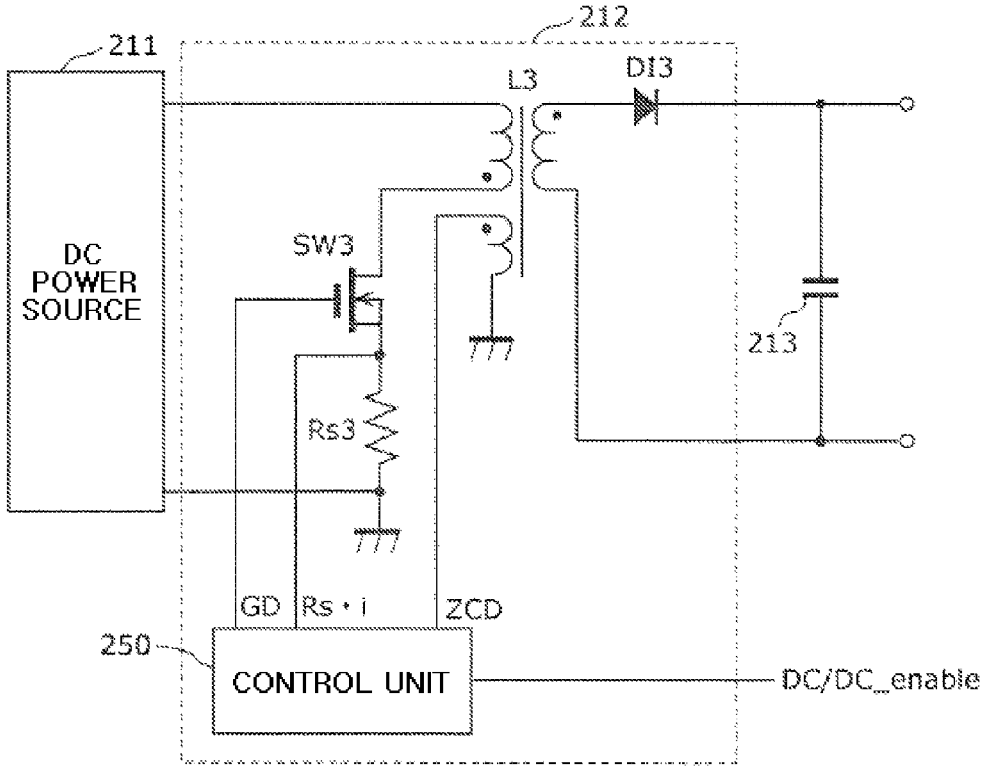
FIG. 22 is a circuit diagram showing another configuration example of a constant-current circuit according to the embodiments.
Figure 23:
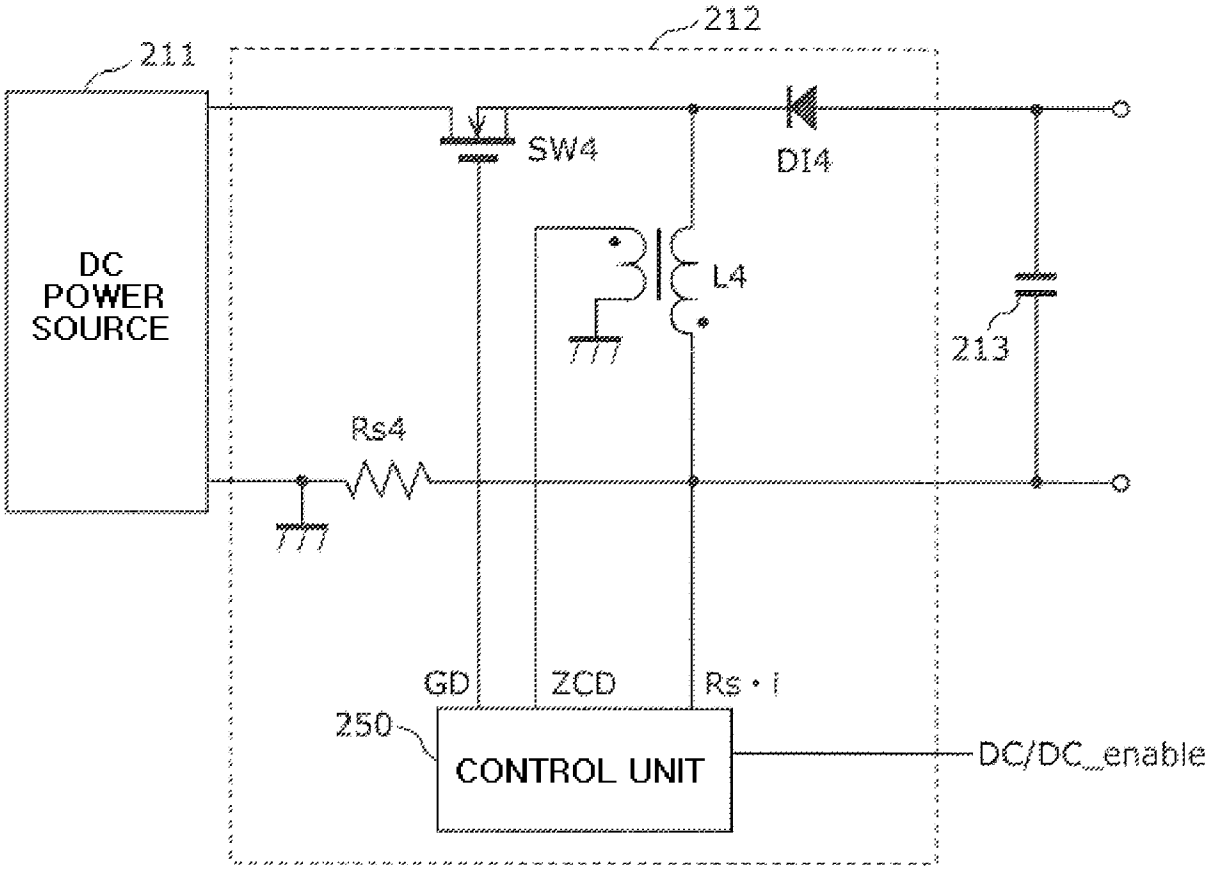
FIG. 23 is a circuit diagram showing another configuration example of a constant-current circuit according to the embodiments.

A step-down DC-to-DC converter shown in FIG. 21, a flyback DC-to-DC converter shown in FIG. 22, or a step-up/step-down DC-to-DC converter shown in FIG. 23 may be used as the constant-current circuit 212.

As described above, the constant-current circuit 212 is a DC-to-DC converter, and may include the switching element SW1 (or SW2 or SW3 or SW4), the inductor L1 (or L2 or L3 or L4) in which current from the DC power source 211 flows while the switching element SW1 (or SW2 or SW3 or SW4) is turned on, the diode DI1 (or DI2 or DI3 or DI4) through which current discharged from the inductor L1 (or L2 or L3 or L4) is supplied to the LEDs 202*a* and 202*b*, and the control unit 250 that controls on/off of the switching element SW1 (or SW2 or SW3 or SW4).

Fifth Embodiment

At first, elements of a lighting device according to the fifth embodiment will be described with reference to FIG. 24.

Figure 24:
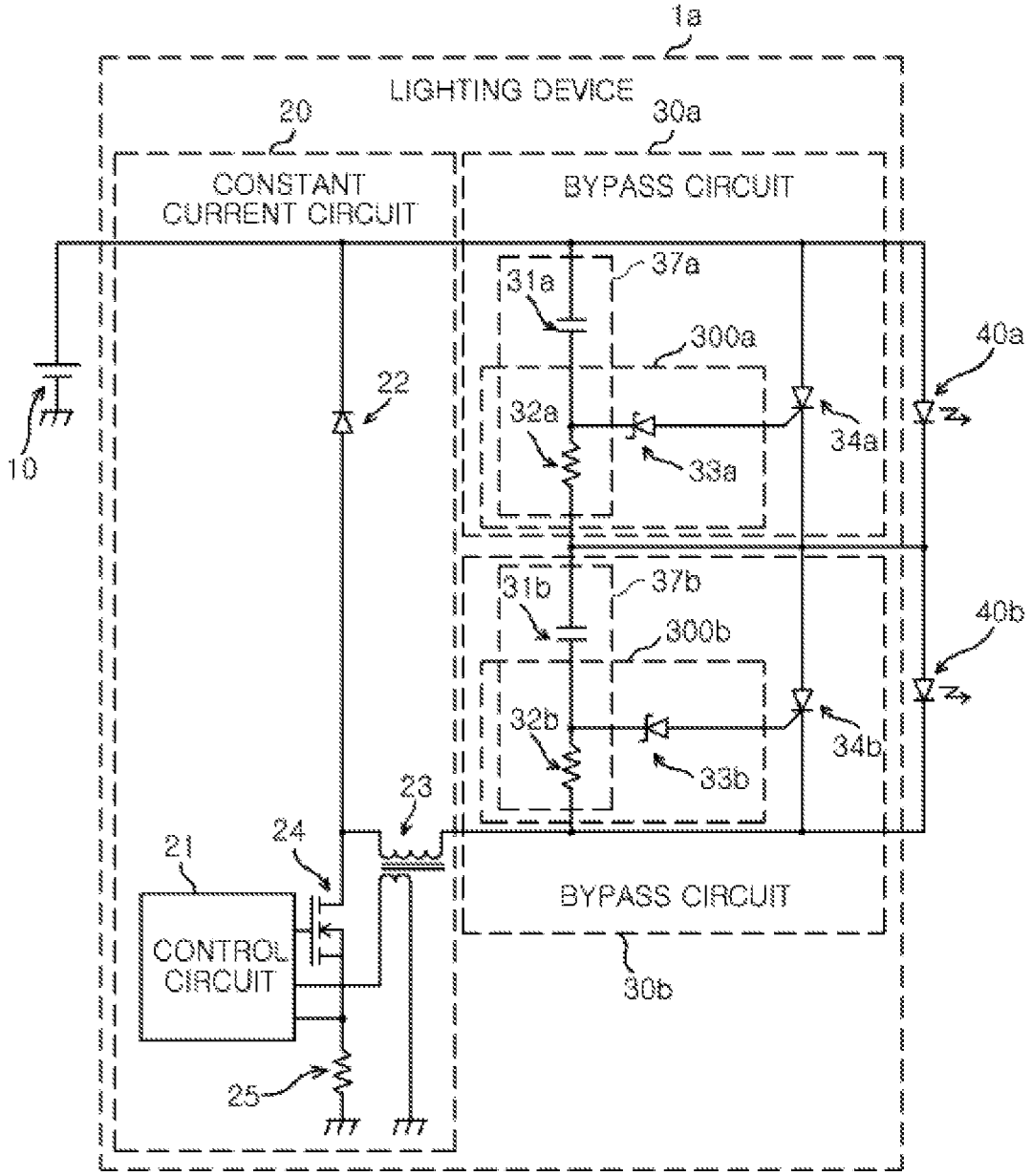
FIG. 24 is a circuit diagram of a lighting device 1*a* according to a fifth embodiment.

FIG. 24 is a circuit diagram of a lighting device according to the fifth embodiment of the present invention.

As shown in FIG. 24, the lighting device 1*a* according to the fifth embodiment receives DC power from a DC power source 10 to light LEDs 40*a* and 40*b* connected in series. The lighting device 1*a* includes a constant-current circuit 20 and bypass circuits 30*a* and 30*b*.

The LEDs 40*a* and 40*b* shown in FIG. 24 are solid-state light-emitting elements that are connected in series and are lit upon receiving current from the constant-current circuit 20. Each of the LEDs 40*a* and 40*b* may be formed of a single LED chip or may be formed of LED chips connected in series or in parallel.

The constant-current circuit 20 shown in FIG. 24 converts current supplied from the DC power source 10 to a predetermined current and supplies the predetermined current to the LEDs 40*a* and 40*b* connected in series. The constant-current circuit 20 includes a control circuit 21, a diode 22, an inductor 23, a FET (field effect transistor) 24, and a detection resistor 25.

The control circuit 21 of the constant-current circuit 20 outputs a signal to control on/off of the FET 24.

The FET 24 of the constant-current circuit 20 is a switching element that is controlled by the signal outputted from the control circuit 21.

The inductor 23 of the constant-current circuit 20 is an inductive element through which current from the DC power source 10 flows while the FET 24 is tuned on.

The diode 22 of the constant-current circuit 20 is an element through which current discharged from the inductor 23 is supplied to the LEDs 40*a* and 40*b*.

The detection resistor 25 of the constant-current circuit 20 is for detecting current flowing in the FET 24.

In this embodiment, the constant-current circuit 20 is a DC-to-DC converter that performs BCM (boundary current mode) control. Specifically, while the FET 24 is conductive, the control circuit 21 of the constant-current circuit 20 detects whether a current flowing in the detection resistor 25 reaches a peak current and, if so, turns the FET 24 to be non-conductive. Additionally, while the FET 24 is non-conductive, the control circuit 21 detects whether the current flowing in the inductor 23 becomes zero and, if so, turns the FET 24 to be conductive.

The bypass circuits 30*a* and 30*b* shown in FIG. 24 are connected in parallel to the LED 40*a* and 40*b*, respectively. The bypass circuits 30*a* and 30*b* provide bypass paths for bypassing the LEDs 40*a* and 40*b*, respectively, when open-circuit failures occur in the LED 40*a* and 40*b*. The bypass circuit 30*a* includes a capacitor 31*a*, a resistor 32*a*, a zener diode 33*a* and a thyristor 34*a*. The bypass circuit 30*b* includes a capacitor 31*b*, a resistor 32*b*, a zener diode 33*b* and a thyristor 34*b*.

The capacitor 31*a* and the resistor 32*a* are connected in series to each other and form a capacitor circuit 37*a*. The capacitor circuit 37*a* is connected in parallel to the LED 40*a*. Likewise, the capacitor 31*b* and the resistor 32*b* are connected in series to each other and form a capacitor circuit 37*b*. The capacitor circuit 37*b* is connected in parallel to the LED 40*b*. Herein, the resistors 32*a* and 32*b* are also included in current detection units 300*a* and 300*b*, respectively.

If open-circuit failures occur in the LEDs 40*a* and 40*b*, currents flowing in the capacitors 31*a* and 31*b* increase, respectively. Therefore, the open-circuit failures can be detected by measuring the currents. The capacitors 31*a* and 31*b* also work as smoothing capacitors for the output from the constant-current circuit 20. Namely, pulsating components in the output current from the constant-current circuit 20 caused by the switching of the FET 24 are smoothened by the capacitors 31*a* and 31*b*, so that smooth DC current flows in the LEDs 40*a* and 40*b*.

The thyristor 34*a* of the bypass circuit 30*a* and the thyristor 34*b* of the bypass circuit 30*b* are bypass switches that are connected in parallel to the capacitor circuits 37*a* and 37*b*, respectively.

The resistor 32*a* and the zener diode 33*a* of the bypass circuit 30*a* constitute a current detection unit 300*a* that detects whether a current flowing in the capacitor 31*a* exceeds a predetermined threshold Ith. Specifically, a current flowing in the capacitor 31*a* is measured by the zener diode 33*a* based on a voltage across the resistor 32*a* connected in series to the capacitor 31*a*. When the current I31*a* flowing in the capacitor 31*a* exceeds the threshold Ith, a zener voltage Vza is determined so that the voltage across the resistor 32*a* exceeds the zener voltage Vza of the zener diode 33*a*. Accordingly, the zener voltage Vza is determined by the following equation:

$$Vza=Ra\times Ith \quad \text{(Equation 1)}$$

where Ra denotes the resistance of the resistor 32*a*.

In addition, when the measured current exceeds the threshold Ith, the current detection unit 300*a* allows current to flow from the zener diode 33*a* to the thyristor 34*a* to thereby turn the thyristor 34*a* to be conductive.

Likewise, the resistor 32*b* and the zener diode 33*b* of the bypass circuit 30*b* constitute a current detection unit 300*b* that detects whether a current flowing in the capacitor 31*b* exceeds a predetermined threshold Ith. The zener voltage Vzb of the zener diode 33*b* is determined by the following equation:

$$Vzb=Rb\times Ith \quad \text{(Equation 2)}$$

where Rb denotes the resistance of the resistor 32*b*.

When the measured current exceeds the threshold Ith, the current detection unit 300*b* allows current to flow from the zener diode 33*b* to the thyristor 34*b* to thereby turn the thyristor 34*b* to be conductive.

The threshold Ith is larger than the output current from the constant-current circuit 20 and equal to or less than two times the output current. Herein, the output current from the constant-current circuit 20 corresponds to a peak current flowing in the capacitors 31*a* and 31*b* in the normal operation state (where no open-circuit failure has occured in the LEDs 40*a* and 40*b*). The two times the output current from the constant-current circuit 20 corresponds to a peak current flowing in the capacitors 31*a* or 31*b* when an open-circuit failure has occurred in the LED 40*a* or 40*b*.

Next, the operations of the lighting device 1*a* and the bypass circuits 30*a* and 30*b* according to the fifth embodiment will be described. As an example of the operations, a scenario where an open-circuit failure occurs in the LED 40*b* will be described with reference to FIGS. 25 to 27.

Figure 25:
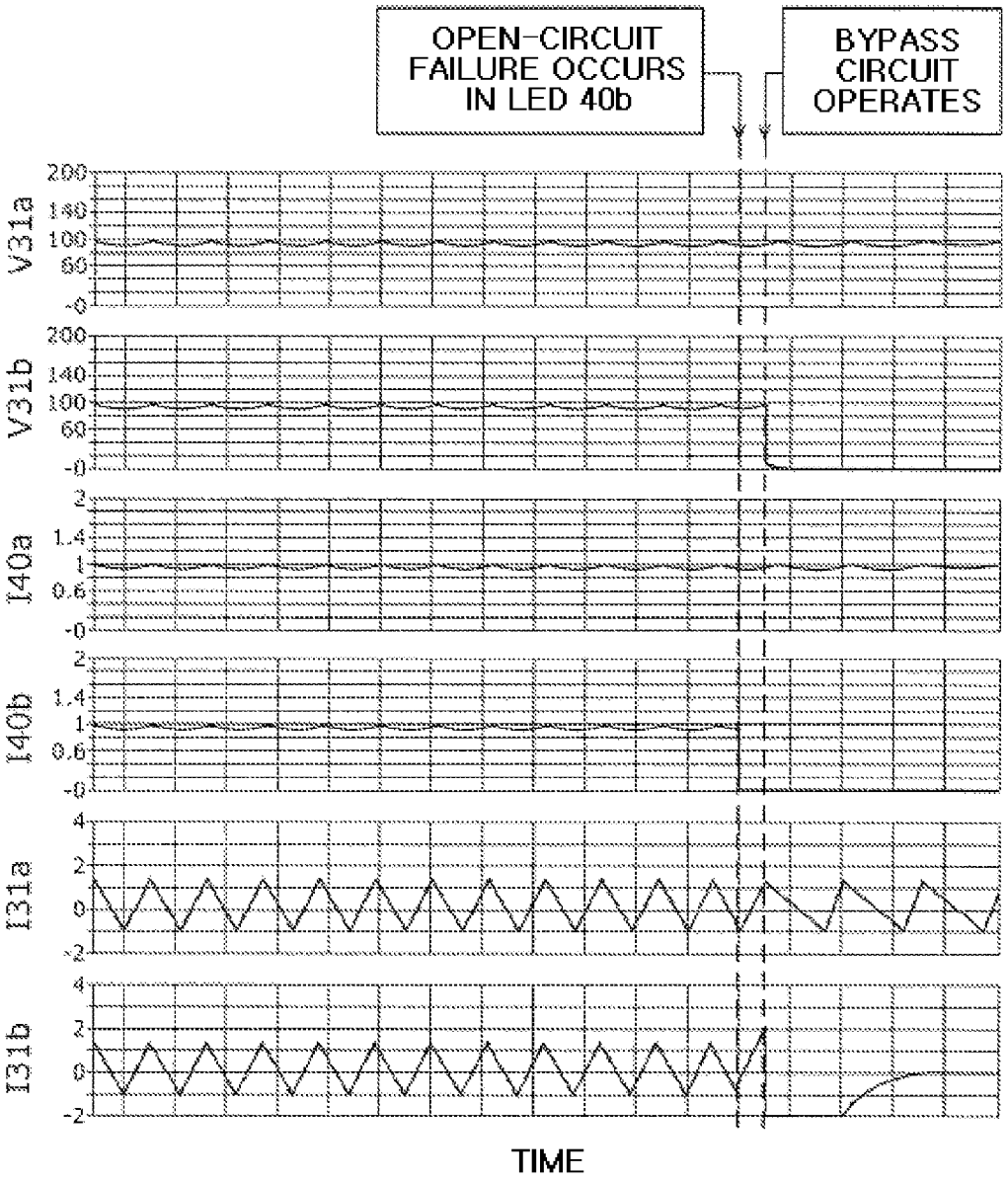
FIG. 25 shows waveforms of current and voltage of elements in the lighting device 1*a* according to the fifth embodiment.

FIG. 25 shows graphs of waveforms of voltages V31*a* and V31*b* across the capacitors 31*a* and 31*b* of the lighting device 1*a*, respectively, versus time. FIG. 25 also shows graphs of waveforms of currents I31*a*, I31*b*, I40*a* and I40*b* flowing in the capacitor 31*a* and 31*b* and the LEDs 40*a* and 40*b*, respectively, versus time.

Figure 26:
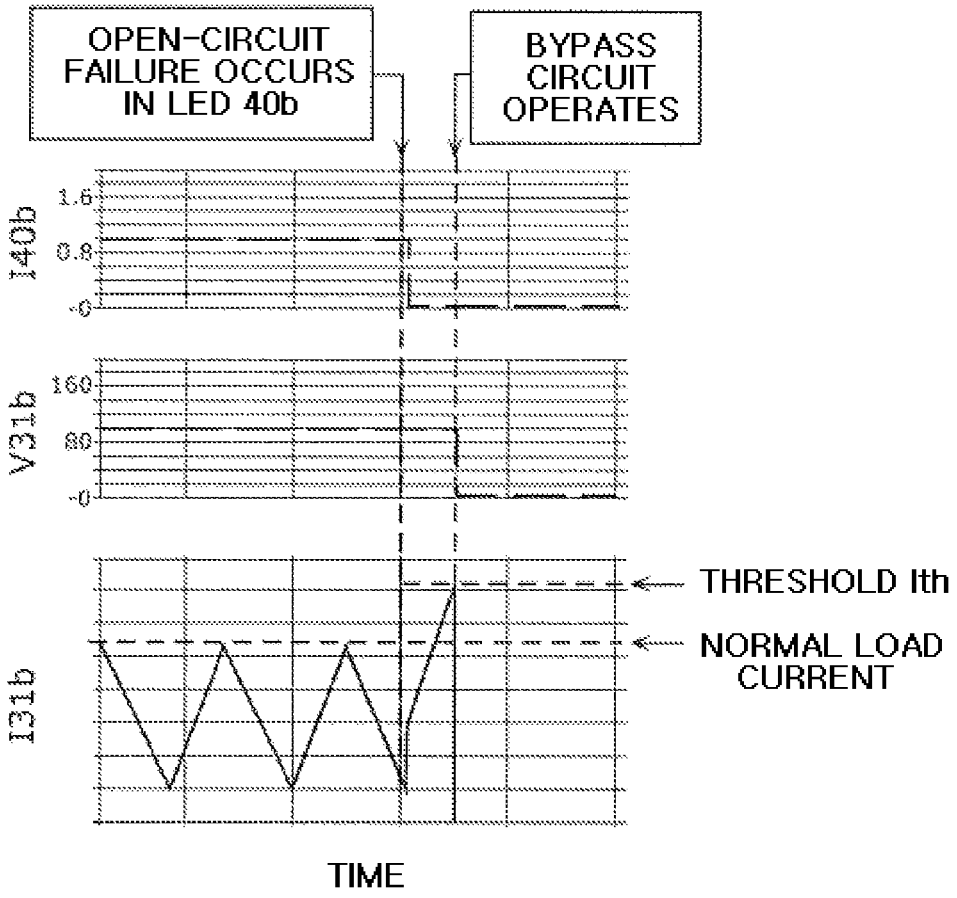
FIG. 26 shows enlarged waveforms of current and voltage of elements in the lighting device 1*a* according to the fifth embodiment.

FIG. 26 is an enlarged view of a part of the waveforms of voltages and currents shown in FIG. 25. FIG. 26 shows the waveforms of the currents I40*b* and I31*b* flowing in the LED 40*b* and the capacitor 31*b*, respectively, versus time, and the waveform of the voltage V31*b* across the capacitor 31*b* versus time.

Figure 27:
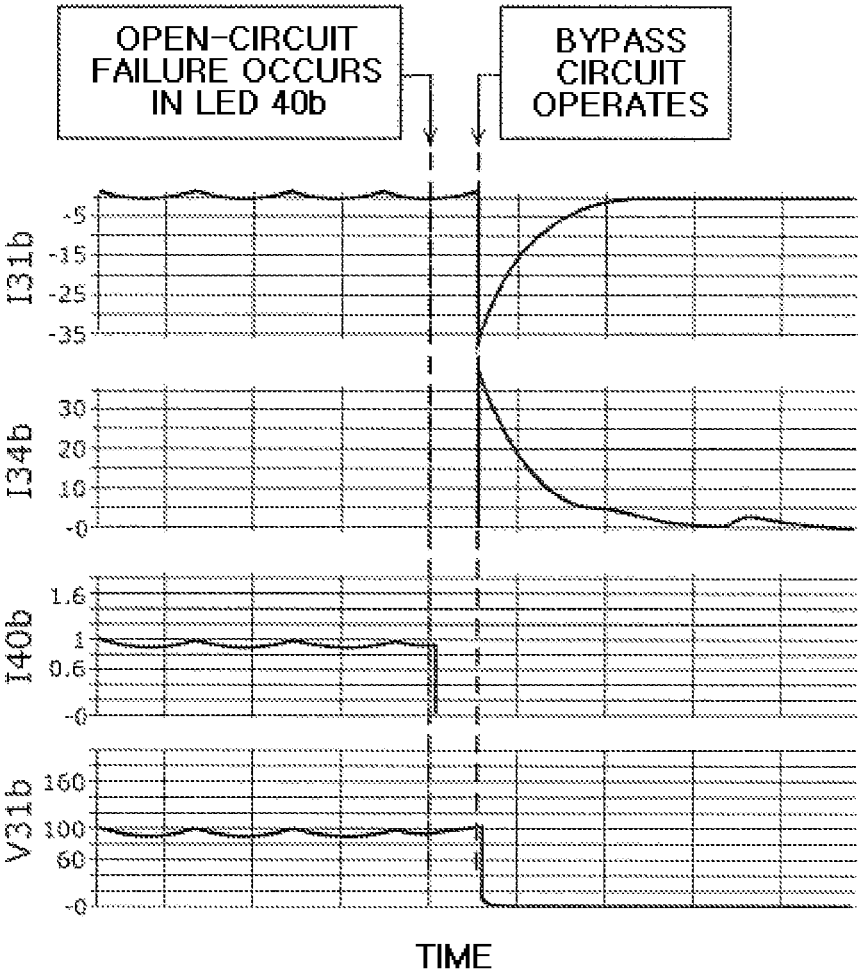
FIG. 27 shows enlarged waveforms of current and voltage of elements in the lighting device 1*a* according to the fifth embodiment.

FIG. 27 is an enlarged view of a part of the waveforms of voltages and currents shown in FIG. 25, and there is also depicted a waveform of the current I34*b* flowing in the thyristor 34*b* versus time. FIG. 27 shows the waveforms of the currents I31*b*, I34*b* and I40*b* flowing in the capacitor 31*b*, the thyristor 34*b* and the LED 40*b*, respectively, versus time. FIG. 27 further shows the waveform of the voltage V31*b* across the capacitor 31*b* versus time.

For the lighting device 1*a* according to the fifth embodiment, if an open-circuit failure occurs in the LED 40*b*, the current I40*b* flowing in the LED 40*b* becomes zero, as shown in FIGS. 25 to 27. When no more current flows in the LED 40*b*, the current having flowed in the LED 40*b* before the open-circuit failure occurs flows to the capacitor 31*b* connected in parallel to the LED 40*b*. Therefore, as shown in FIGS. 25 and 26, a DC component is added to the current I31*b* flowing in the capacitor 31*b*. Herein, the DC component refers to a frequency component lower than the switching frequency of the FET 24. Then, as described above, the current I31*b* flowing in the capacitor 31*b* increases up to about two times the peak current of a normal operation state. Further, the voltage V31*b* across the capacitor 31*b* increases slowly.

As the current I31*b* flowing in the capacitor 31*b* increases, the current flowing through the resistor 32*b* connected in series to the capacitor 31*b* and the voltage across the resistor 32*b* also increase. Further, when the current I31*b* flowing in the capacitor 31*b* exceeds the threshold Ith and the voltage across the resistor 32*b* exceeds the zener voltage Vzb of the zener diode 33*b*, current abruptly flows in the zener diode 33*b*. The current flows from the anode of the zener diode 33*b* to the gate of the thyristor 34*b*, so that the thyristor 34*b* becomes conductive. Consequently, a bypass path for bypassing the LED 40*b* is turned on.

When the bypass path for bypassing the LED 40*b* is turned on, electric charges accumulated in the capacitor 31*b* are released. The current generated by these electric charges flows in a closed circuit that is formed of the capacitor 31*b*, the thyristor 34*b* and the resistor 32*b* (see the waveforms of the currents I13*b* and I34*b* in FIG. 27) but does not flow in the normal LED 40*a* (see the waveform of the current I40*a* in FIG. 25).

Now, the operation of the LED 40*a* when the thyristor 34*b* is conductive will be described. Immediately after an open-circuit failure has occurred in the LED 40*b*, current flows through the capacitor 31*b* (see the waveform of the current I31*b* in FIG. 26). Therefore, the normal LED 40*a* is kept at a lighted state even during a time period after the open-circuit failure has occurred in the LED 40*b* until the thyristor 34*b* is conductive (see the waveform of the current I40*a* in FIG. 25).

Next, a time period required until the current detection unit 300*b* turns the thyristor 34*b* to be conductive after the open-circuit failure has occurred in the LED 40*b* will be discussed below. The period of the pulsation of the current I31*b* flowing in the capacitor 31*b* shown in FIGS. 25 and 26 corresponds to the switching period of the FET 24 of the constant-current circuit 20. Further, as shown in FIG. 26, the current I31*b* exceeds the threshold Ith until the current I31*b* reaches the peak of its pulsation after the open-circuit failure has occurred in the LED 40*b* and then the DC component is added to the current I31*b*. Accordingly, the detection time can be reduced below the period of the pulsation of the current I31*b*, i.e., below the switching period of the FET 24. By doing so, the thyristor 34*b* can become conductive with a less amount of electric charges accumulated in the capacitor 31*b*. Accordingly, excessive current to be generated at the instant when the thyristor 34*b* becomes conductive can be suppressed, so that stress to be exerted on the bypass circuits 30*a* and 30*b* can be suppressed.

As described above, the lighting device 1*a* according to the fifth embodiment includes: the constant-current circuit 20 that supplies a constant current to the plurality of LEDs 40*a* and 40*b* connected in series; the capacitor circuits 37*a* and 37*b* connected in parallel to the LEDs 40*a* and 40*b*, respectively; the thyristors 34*a* and 34*b* connected in parallel to the capacitor circuits 37*a* and 37*b*, respectively; and the current detection units 300*a* and 300*b* configured to measure currents flowing through the capacitors 31*a* and 31*b*, respectively. The current detection units 300*a* and 300*b* turn on the thyristors 34*a* and 34*b*, respectively, when the measured currents exceed the predetermined threshold Ith.

In this manner, immediately after the thyristors 34*a* or 34*b* serving as bypass switches become conductive, the current from the capacitor 31*a* or 31*b* does not flow in the normal LED, and thus stress exerted on the normal LED is mitigated. In addition, according to the fifth embodiment, even during the time period after an open-circuit failure has occurred in one of the LEDs 40*a* and 40*b* until the bypass switch is turned on, current flows in the other one of the LEDs 40*a* and 40*b* so that the other one of the LEDs 40*a* and 40*b* is kept at a lighted state.

Further, the lighting device 1*a* according to the fifth embodiment may include the resistors 32*a* and 32*b* connected in series to the capacitors 31*a* and 31*b*, respectively. The current detection units 300*a* and 300*b* may measure the currents flowing through the capacitors 31*a* and 31*b* based on the voltages across the resistors 32*a* and 32*b*, respectively.

By doing so, the current detection units 300*a* and 300*b* of the lighting device 1*a* can accurately measure the currents flowing through the capacitors 31*a* and 31*b*, respectively.

Furthermore, in the lighting device 1*a* according to the fifth embodiment, the constant-current circuit 20 is a DC-to-DC converter that is controlled in a BCM manner. The predetermined threshold Ith is larger than the output current of the constant-current circuit 20 and is equal to or less than two times the output current.

By doing so, the threshold Ith can be set so that an open-circuit failure in the LED 40*a* or 40*b* can be detected.

Sixth Embodiment

Next, a lighting device according to the sixth embodiment will be described.

The basic elements and operations of the lighting device according to the sixth embodiment are identical to those according to the fifth embodiment except for the configuration of the current detection unit. Therefore, descriptions will be made focusing on the differences between the fifth and sixth embodiments.

According to the above fifth embodiment, when the lighting device 1*a* undergoes a transitional behavior such as start-up, large currents flow in the capacitors 31*a* and 31*b*, and thus the current detection units 300*a* and 300*b* may malfunction.

In this regard, according to the sixth embodiment, there is provided a lighting device capable of suppressing such malfunction of the current detection units.

At first, elements of a lighting device according to the sixth embodiment will be described with reference to FIG. 28.

Figure 28:
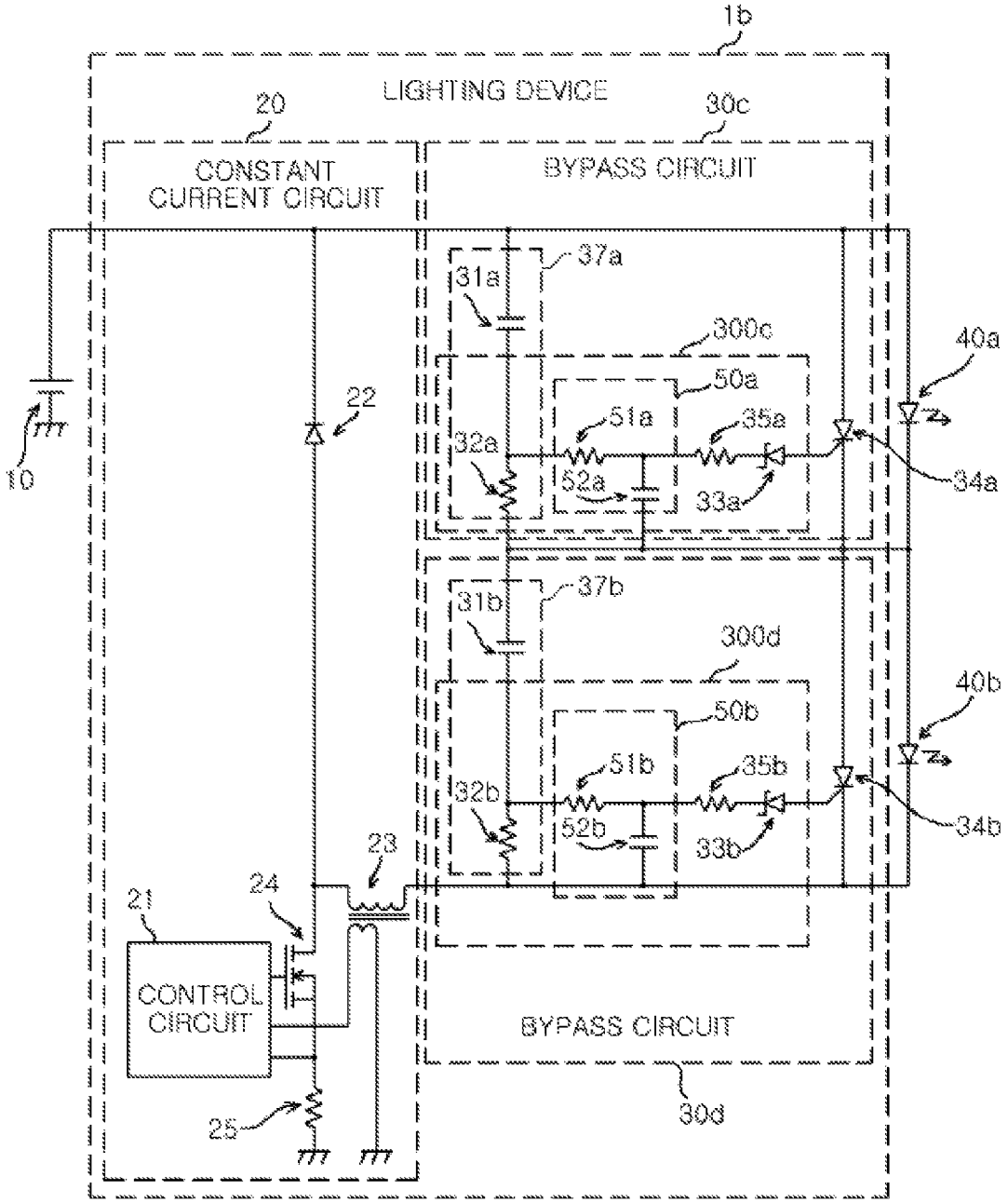
FIG. 28 is a circuit diagram of a lighting device 1*b* according to a sixth embodiment.

FIG. 28 is a circuit diagram of a lighting device according to the sixth embodiment of the present invention.

As can be seen from FIG. 28, the lighting device 1*b* according to the sixth embodiment is different in the configurations of the current detection unit 300*c* of the bypass circuit 30*c* and the current detection unit 300*d* of the bypass circuit 30*d*, compared to the lighting device 1*a* according to the fifth embodiment. In the lighting device 1*b*, the current detection unit 300*c* has therein a RC (resistor-capacitor) filter 50*a* and a resistor 35*a*, and the current detection unit 300*d* has therein a RC filter 50*b* and a resistor 35*b*.

The RC filters 50*a* and 50*b* are high-cut filters that attenuate high-frequency components in voltage applied to cathodes of zener diodes 33*a* and 33*b*, respectively. The RC filter 50*a* includes a resistor 51*a* and a capacitor 52*a*. The RC filter 50*b* includes a resistor 51*b* and a capacitor 52*b*. The resistors 35*a* and 35*b* are resistors for preventing malfunction of the current detection units 300*c* and 300*d* by limiting current flowing in the thyristors 34*a* and 34*b*, respectively.

Next, the operation of the lighting device 1*b* according to the sixth embodiment will be described with reference to FIG. 29.

Figure 29:
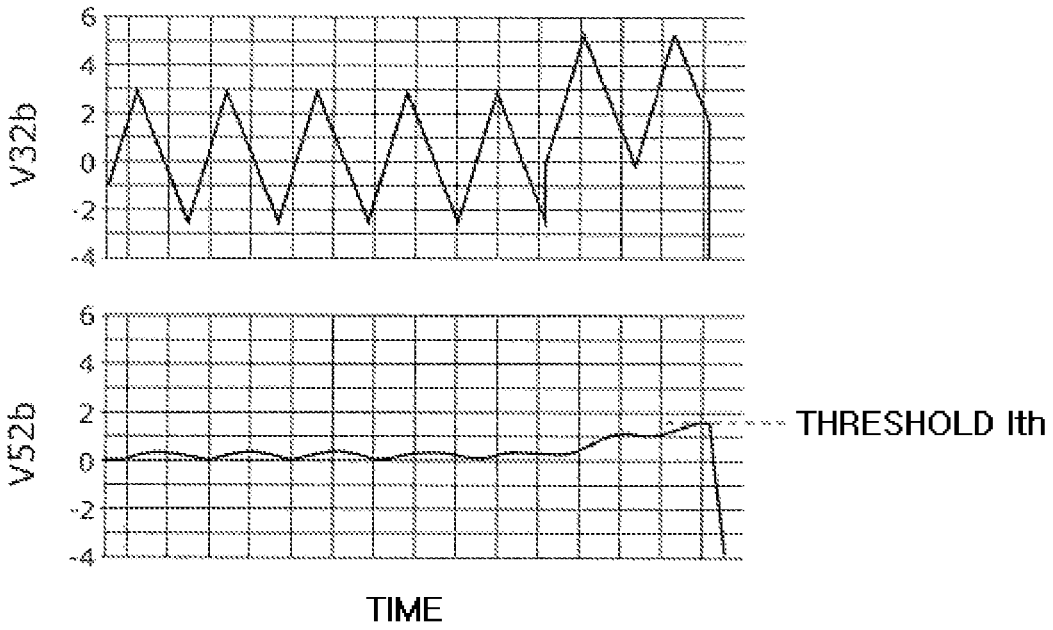
FIG. 29 shows voltage waveforms of elements in the lighting device 1*b* according to the sixth embodiment.

FIG. 29 shows graphs of waveforms of a voltage V32*b* across the resistor 32*b* and a voltage V52*b* across the capacitor 52*b* versus time, when an open-circuit failure occurs in the LED 40*b*.

As shown in FIG. 29, the pulsation, which is high-frequency component, in the voltage across the resistor 32*b* is suppressed by the RC filter 50*b*. Therefore, the current detection units 300*c* and 300*d* can detect the DC component in the current flowing in the capacitors 31*a* and 31*b*, respectively, other than the high-frequency component. According to the sixth embodiment, the zener diodes 33*a* and 33*b* are chosen so that the voltages applied to the zener diodes 33*a* and 33*b* exceeds their zener voltages, respectively, when the DC component in the current flowing in the capacitors 31*a* and 31*b* exceeds the threshold Ith.

As described above, in the lighting device 1*b* according to the sixth embodiment, the current detection units 300*c* and 300*d* include RC filters 50*a* and 50*b* that attenuate high-frequency components in the current. Further, the current detection units 300*c* and 300*d* detect the DC component in the current flowing in the capacitors 31*a* and 31*b*, respectively.

In this manner, the lighting device 1*b* according to the sixth embodiment can suppress the malfunction of the current detection units 300*c* and 300*d* due to a transitional behavior such as start-up and the like.

In addition, the lighting device 1*b* according to the sixth embodiment includes resistors 35*a* and 35*b* for preventing malfunction.

With the resistors 35*a* and 35*b*, in the lighting device 1*b* according to the sixth embodiment, currents flowing in the thyristors 34*a* and 34*b* are suppressed, so that malfunction of the thyristors 34*a* and 34*b* can be suppressed.

Seventh Embodiment

Next, a lighting device according to the seventh embodiment will be described.

The basic elements and operations of the lighting device according to the seventh embodiment are identical to those according to the fifth embodiment except for the configuration of the bypass circuit. Therefore, descriptions will be made focusing on the differences between the fifth and seventh embodiments.

In the lighting device 1*a* according to the above fifth embodiment, excessive currents flows in the bypass circuits 30*a* and 30*b* immediately after the bypass circuits 30*a* and 30*b* operate, respectively (see the waveforms of the currents I31*b* and I34*b* shown in FIG. 27). Consequently, stress may be exerted on the thyristors 34*a* and 34*b* of the bypass circuits 30*a* and 30*b*, or the like.

In this regard, according to the seventh embodiment, there is provided a lighting device capable of suppressing excessive current flowing immediately after the bypass circuits operate.

At first, elements of a lighting device according to the seventh embodiment will be described with reference to FIG. 30.

Figure 30:
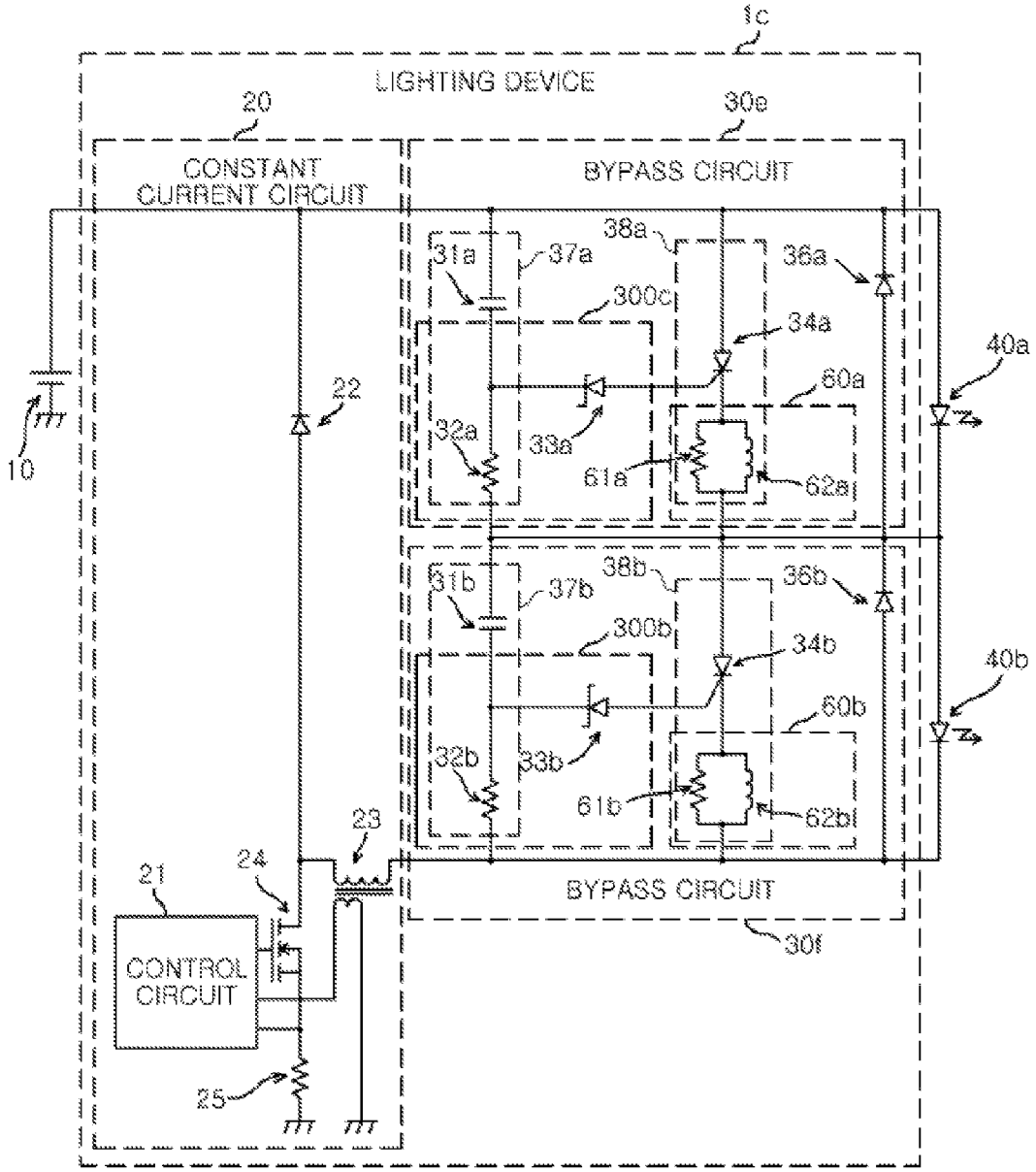
FIG. 30 is a circuit diagram of a lighting device 1*c* according to a seventh embodiment.

FIG. 30 is a circuit diagram of a lighting device according to the seventh embodiment of the present invention.

As can be seen from FIG. 30, the lighting device 1*c* according to the seventh embodiment is different from the lighting device 1*a* according to the fifth embodiment in the configurations of the bypass circuits 30*e* and 30*f*.

According to the seventh embodiment, the bypass circuit 30*e* has therein an impedance element 60*a* and a diode 36*a*, and the bypass circuit 30*f* has therein an impedance element 60*b* and a diode 36*b*.

The impedance elements 60*a* and 60*b* are connected in series to the thyristors 34*a* and 34*b*, respectively. The impedance element 60*a* and the thyristor 34*a* form a bypass switch circuit 38*a* and the bypass switch circuit 38*a* is connected in parallel to the LED 40*a*. Likewise, the impedance element 60*b* and the thyristor 34*b* form a bypass switch circuit 38*b* and the bypass switch circuit 38*b* is connected in parallel to the LED 40*b*.

The impedance elements 60*a* and 60*b* suppress currents flowing in the bypass circuits 30*e* and 30*f* immediately after the bypass circuits 30*e* and 30*f* operate. The impedance element 60*a* includes a thermistor 61*a* and an inductor 62*a*. The impedance element 60*b* includes a thermistor 61*b* and an inductor 62*b*.

The thermistors 61*a* and 61*b* are NTC (negative temperature coefficient) thermistors whose resistance decreases with increase of temperature. The thermistors 61*a* and 61*b* have high resistance at a low temperature. Therefore, when the current is zero and the temperature is low, the thermistors 61*a* and 61*b* can suppress the current from increasing abruptly.

The inductors 62*a* and 62*b* are elements that resist change in current, and thus they can suppress the current from increasing abruptly. Further, the resistance of the inductors 62*a* and 62*b* is almost zero, if there is no change in current. Therefore, in the operation of the bypass circuits 30*e* and 30*f*, when currents flowing in the thyristors 34*a* and 34*b* become constant, currents flow in the inductors 62*a* and 62*b* and thus loss can be reduced.

The diodes 36*a* and 36*b* are connected in parallel to the LEDs 40*a* and 40*b*, respectively, and suppress oscillation of current caused by the inductors 62*a* and 62*b*.

Next, the operation of the lighting device 1*c* according to the seventh embodiment will be described with reference to FIG. 31.

Figure 31:
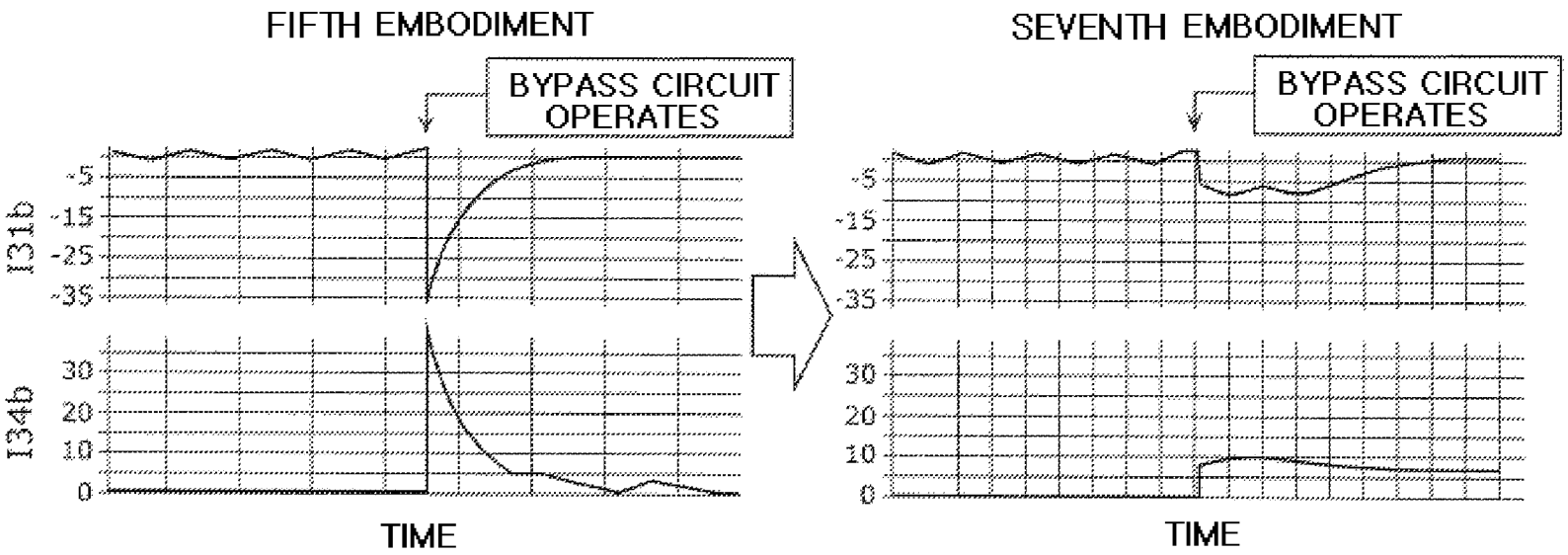
FIG. 31 shows current waveforms of elements in the lighting device 1*a* according to the fifth embodiment and the lighting device 1*c* according to the seventh embodiment.

FIG. 31 shows graphs of waveforms of the currents I31*b* and I34*b* flowing in the capacitor 31*b* and the thyristor 34*b*, respectively, versus time in the case where an open-circuit failure occurs in the LED 40*b*, according to the fifth and seventh embodiment.

As shown in FIG. 31, according to the fifth embodiment, when an open-circuit failure occurs in the LED 40*b*, the bypass circuit 30*b* operates, and immediately thereafter, the current increases abruptly. On the other hand, according to the seventh embodiment, the current also increases immediately after the bypass circuit 30*f* operates, but the peak value of the current is significantly reduced.

As described above, the lighting device 1*c* according to the seventh embodiment includes the impedance elements 60*a* and 60*b* which are connected in series to the thyristors 34*a* and 34*b* serving as bypass switches, respectivelys.

With the impedance elements 60*a* and 60*b*, it is possible to suppress abrupt increase in current immediately after the bypass circuits 30*e* and 30*f* operate. In addition, in a normal operation state, the bypass circuits 30*e* and 30*f* allow current to flow in the inductors 62*a* and 62*b*, so that the loss can be reduced.

The lighting device 1*c* according to the seventh embodiment further includes the diodes 36*a* and 36*b* which are connected in parallel to the LEDs 40*a* and 40*b*, respectively.

With the diodes 36*a* and 36*b*, it is possible to suppress oscillation of current caused by the inductors 62*a* and 62*b*.

Eighth Embodiment

Next, a lighting device according to the eighth embodiment will be described.

The basic elements and operations of the lighting device according to the eighth embodiment are identical to those according to the fifth embodiment except for the configuration of the bypass circuit. Therefore, descriptions will be made focusing on the differences between the fifth and eighth embodiments.

According to the eighth embodiment, there is provided a lighting device capable of more accurately detecting current than the lighting device 1*a* of the fifth embodiment.

At first, elements of a lighting device according to the eighth embodiment will be described with reference to FIG. 32.

Figure 32:
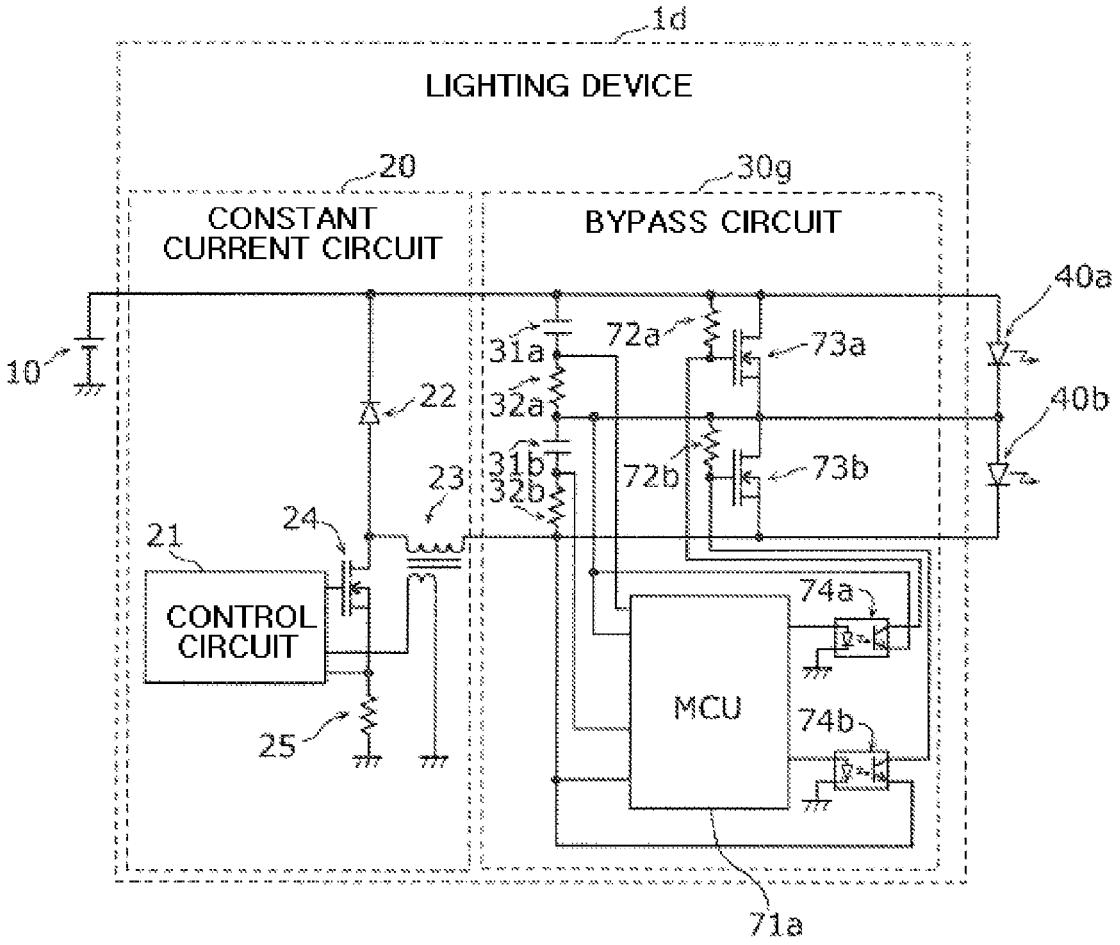
FIG. 32 is a circuit diagram of a lighting device 1*d* according to an eighth embodiment.

FIG. 32 is a circuit diagram of a lighting device according to the eighth embodiment of the present invention.

As can be seen from FIG. 32, the lighting device 1*d* according to the eighth embodiment is different in the configurations of a bypass circuit 30*g* from the lighting device 1*a* of the fifth embodiment. The bypass circuit 30*g* includes an MCU (micro-control unit) 71*a*, photo-couplers 74*a* and 74*b*, MOSFETs (metal oxide semiconductor field effect transistors) 73*a* and 73*b*, and gate resistors 72*a* and 72*b*.

The MCU 71*a* of the bypass circuit 30*g* is a processing unit that measures currents flowing in the capacitors 31*a* and 31*b* to output signals corresponding to the measured currents to the photo-couplers 74*a* and 74*b*. The MCU 71*a* measures currents flowing in the capacitors 31*a* and 31*b* based on the voltages across the resistors 32*a* and 32*b*, respectively.

The MOSFETs 73*a* and 73*b* of the bypass circuit 30*g* are bypass switches. When a high voltage is applied between gate and source of the MOSFETs 73*a* and 73*b*, source-drain channel becomes conductive.

The photo-couplers 74*a* and 74*b* of the bypass circuit 30*g* are elements that transfer electrical signals by using light. The photo-couplers 74*a* and 74*b* transfer signals from the MCU 71*a* to the MOSFETs 73*a* and 73*b*, respectively. Output signals from the MCU 71*a* are inputted to the input circuit sides of the photo-couplers 74*a* and 74*b*. If the output signals from the MCU 71*a* are at high level, the output circuit sides of the photo-couplers 74*a* and 74*b* become conductive. If the output signals from the MCU 71*a* are at low level, the output circuit sides of the photo-couplers 74*a* and 74*b* is not conductive. Since the MCU 71*a* and the MOSFETs 73*a* and 73*b* are electrically isolated by the photo-couplers 74*a* and 74*b*, noise cannot be transmitted.

According to the eighth embodiment, the current detection unit that detects currents flowing in the capacitors 31*a* and 31*b* includes the MCU 71*a*, the resistors 32*a* and 32*b*, and the photo-couplers 74*a* and 74*b*.

Next, the operation of the bypass circuit 30*g* according to the eighth embodiment will be described. As an example of the operations, a scenario where an open-circuit failure occurs in the LED 40*b* will be described.

Similar to the above-described fifth to seventh embodiments, if an open-circuit failure occurs in the LED 40*b*, the DC component is added to the current flowing in the capacitor 31*b*, and accordingly the current flowing in the capacitor 31*b* rises. If the current flowing in the capacitor 31*b* rises, the MCU 71*a* measures the voltage across the resistor 32*b*. Further, the MCU 71 compares the measured value with a reference voltage value, by using a comparator provided therein, to determine whether the current flowing in the capacitor 31*b* exceeds the threshold Ith. The MCU 71*a* outputs a signal of high level to the photo-coupler 74*b* if the current I31*b* flowing in the capacitor 31*b* does not exceed the threshold Ith, whereas the MCU 71*a* outputs a signal of low level to the photo-coupler 74*b* if the current I31*b* exceeds the threshold Ith. The output circuit side of the photo-coupler 74*b* becomes conductive when a signal of high level is received from the MCU 71*a*. The output circuit side of the photo-coupler 74*b* is not conductive when a signal of low level is received from the MCU 71*a*. Accordingly, when the current I31*b* exceeds the threshold Ith, the level of the gate-source voltage of the MOSFET 73*b* becomes high, so that the source-drain channel becomes conductive. Consequently, a bypass path for bypassing the LED 40*b* is turned on. On the other hand, when the current I31*b* does not exceed the threshold Ith, the level of the gate-source voltage of the MOSFET 73*b* becomes low, so that the source-drain channel does not become conductive.

As described above, similar to the fifth embodiment, the lighting device 1*d* according to the eighth embodiment can turn on the bypass path when an open-circuit failure has occurred in one of the LEDs 40*a* and 40*b*, without causing excessive current to flow in the other one of the LEDs 40*a* and 40*b*. Further, according to the eighth embodiment, currents are measured by the MCU 71*a*, so that detection accuracy of the current can be improved. Furthermore, in order to prevent malfunction in a transitional state such as start-up of the lighting device 1*d*, software processing can be performed in the MCU. For example, a mask time period can be set so that the MOSFETs 73*a* and 73*b* of the bypass circuit 30*g* do not become conductive for a certain period of time after the start-up of the lighting device 1*d*. In addition, filtering process on a signal inputted to the MCU 71*a* can be performed by software, thereby preventing malfunction.

Ninth Embodiment

Next, a lighting device according to the ninth embodiment will be described.

The basic elements and operations of the lighting device according to the ninth embodiment are identical to those according to the eighth embodiment except for the configuration of the bypass circuit. Therefore, descriptions will be made focusing on the differences between the fifth and ninth embodiments.

According to the above eighth embodiment, the currents flowing in the capacitors 31*a* and 31*b* of the bypass circuit 30*g* are measured based on the voltages across the resistors 32*a* and 32*b*, respectively. In contrast, according to the ninth embodiment, the currents are measured based on the voltages across the capacitors 31*a* and 31*b*.

At first, elements of a lighting device according to the ninth embodiment will be described with reference to FIG. 33.

Figure 33:
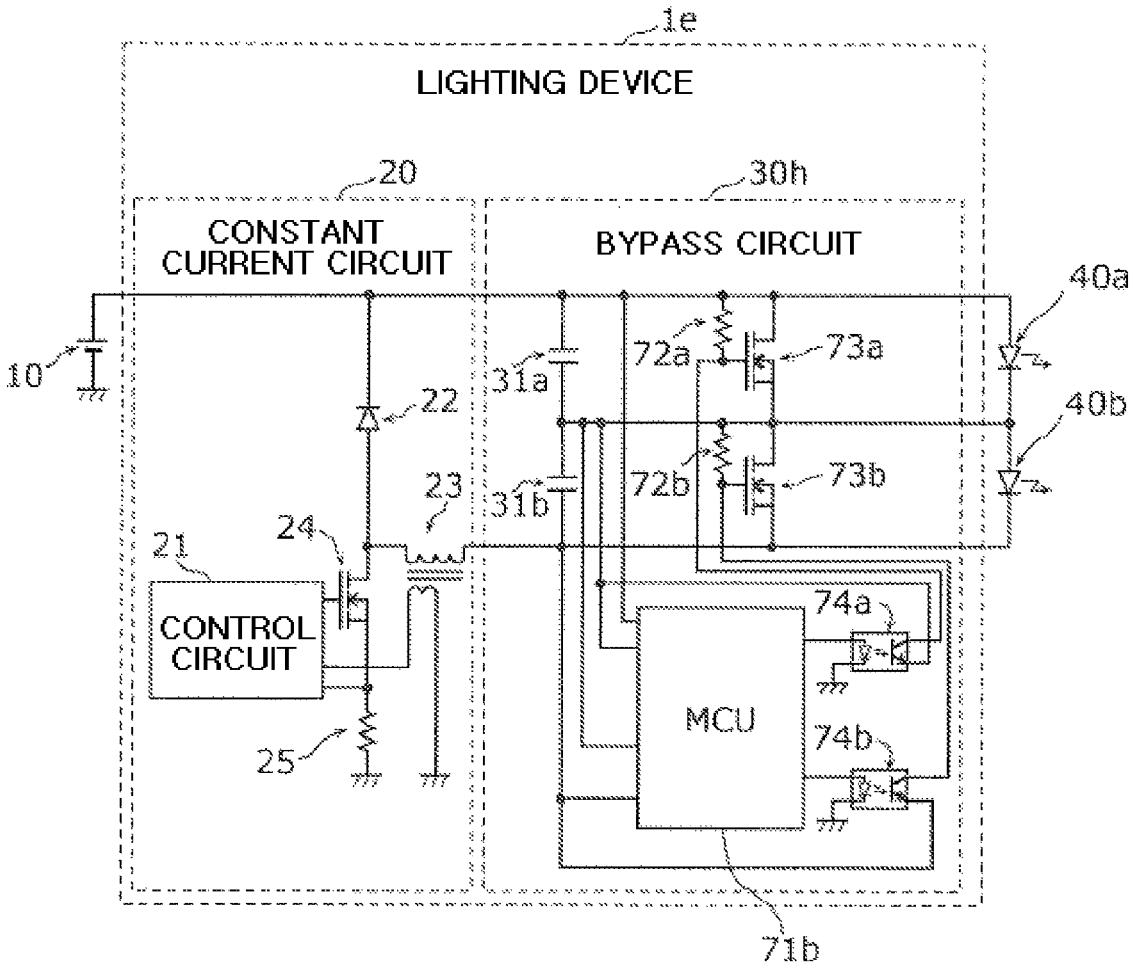
FIG. 33 is a circuit diagram of a lighting device 1*e* according to a ninth embodiment.

FIG. 33 is a circuit diagram of a lighting device according to the ninth embodiment of the present invention.

As can be seen from FIG. 33, the lighting device 1*e* according to the ninth embodiment is different from the lighting device 1*d* of the eighth embodiment in that the voltages across the capacitors 31*a* and 31*b* are measured by an MCU 71*b* of a bypass circuit 30*h*. Therefore, according to the ninth embodiment, the resistors 32*a* and 32*b* used for detecting current in the eighth embodiment are not required. In the ninth embodiment, the current detection unit that measures currents flowing in the capacitors 31*a* and 31*b* includes the MCU 71*b* and the photo-couplers 74*a* and 74*b*.

Next, the operation of the bypass circuit 30*h* in the lighting device 1*e* according to the ninth embodiment will be described. As an example of the operation, a scenario where an open-circuit failure occurs in the LED 40*b* will be described.

Similar to the fifth to eighth embodiments, if an open-circuit failure occurs in the LED 40*b*, the DC component is added to the current flowing in the capacitor 31*b*, and accordingly the current flowing in the capacitor 31*b* rises. As the current flowing in the capacitor 31*b* increases, the voltage across the capacitor 31*b* also increases. The MCU 71*b* measures the voltage across the capacitor 31*b*. Further, the MCU 71*b* compares the measured value with a reference voltage value by using a comparator provided therein to determine whether the current flowing in the capacitor 31*b* exceeds the threshold Ith. The subsequent operations by the MCU 71*b*, the photo-couplers 74*a* and 74*b* and the MOSFETs 73*a* and 73*b* are identical to those of the eighth embodiment.

As described above, the lighting device 1*e* according to the ninth embodiment can also achieve the same effect as that of the eighth embodiment.

Tenth Embodiment

As the tenth embodiment, a luminaire having any one of the lighting devices 210*a* to 210*e* and 1*a* to 1*e* according to the first to the ninth embodiment will be described with reference to FIGS. 34 to 36. The luminaire includes light-emitting elements in addition to the lighting device.

Figure 34:
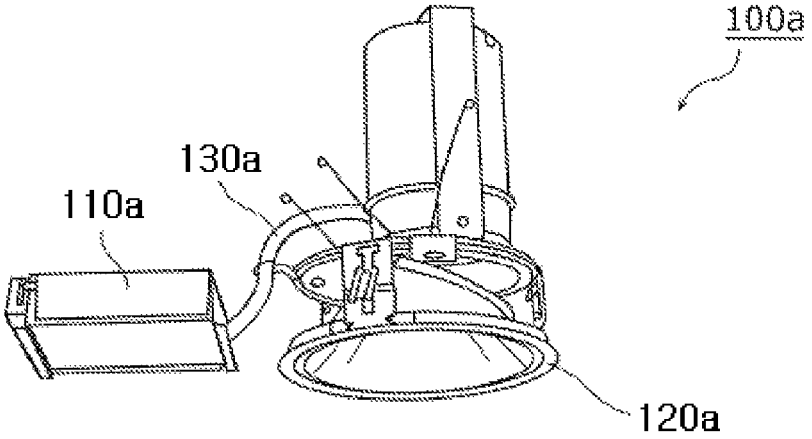
FIG. 34 is an external view of a luminaire according to a tenth embodiment.
Figure 35:
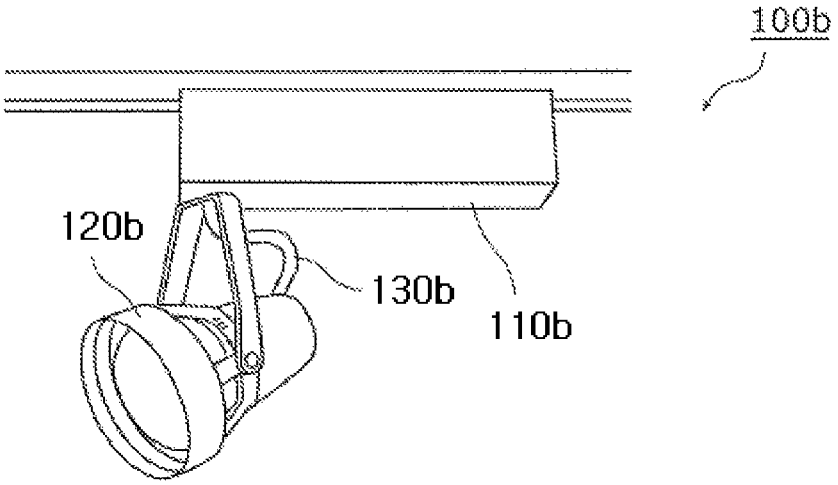
FIG. 35 is an external view of a luminaire according to the tenth embodiment.
Figure 36:
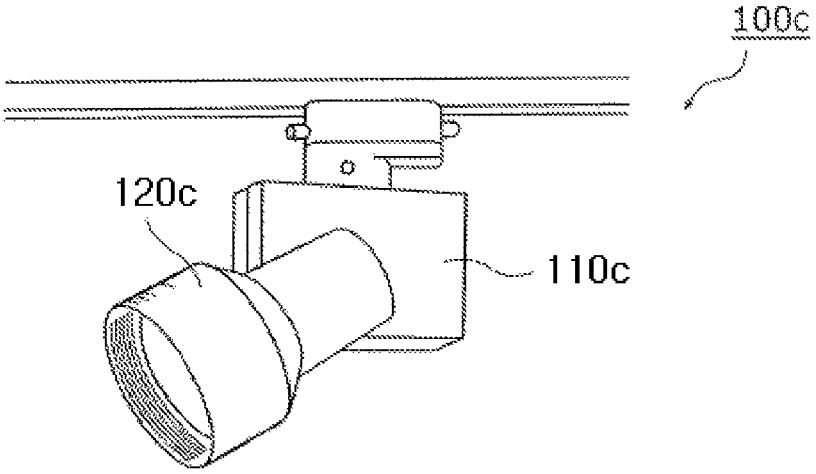
FIG. 36 is an external view of a luminaire according to the tenth embodiment.

FIGS. 34 to 36 are external views of the luminaire having any one of the lighting devices 210*a* to 210*e* and 1*a* to 1*e* according to the first to the ninth embodiments. As examples of the luminaire, a downlight 100*a* (shown in FIG. 34) and spotlights 100*b* and 100*c* (shown in FIG. 35 and FIG. 36, respectively) are illustrated. In FIGS. 34 to 36, circuit boxes 110*a* to 110*c* accommodate a circuit of any one of the lighting devices 210*a* to 210*e* and 1*a* to 1*e*. The LEDs 40*a* and 40*b* or the LED 202*a* and 202*b* are installed in lamp bodies 120*a* to 120*c*. A wire 130*a* in FIG. 34 and a wire 130*b* in FIG. 35 electrically connect the circuit boxes 110*a* and 110*b* with the lamp bodies 120*a* and 120*b*, respectively.

The tenth embodiment can also achieve the same effects as those of the above-described first to ninth embodiments.

(Modification)

Thus far, the lighting devices and the luminaire of the present invention have been described based on the embodiments. However, the present invention is not limited to the embodiments.

For example, in the fifth to ninth embodiments, the two LEDs 40*a* and 40*b* are used as solid-state elements. However, three or more LEDs may be used, each with a capacitor and a bypass switch connected in parallel thereto.

Further, in the fifth to ninth exemplary embodiments, every solid-state light-emitting element is provided with a bypass circuit. However, at least one of the solid-state light-emitting elements may be provided with a bypass circuit. In this instance, an additional smoothing capacitor may be provided between output terminals of the constant-current circuit 20.

Further, in the lighting devices 1*a* to 1*c* according to the fifth to seventh embodiments, the zener diodes 33*a* and 33*b* are used in the current detection units 300*a* to 300*d*. However, the zener diodes 33*a* and 33*b* may not be included the current detection units 300*a* to 300*d*. In other words, two ends of each of the zener diodes 33*a* and 33*b* may be short-circuited. In the case where the zener diodes 33*a* and 33*b* are not employed, however, it is necessary to set characteristics of elements so that the thyristors 34*a* and 34*b* become conductive by the currents flowing to the gate electrodes of the thyristors 34*a* and 34*b* when the currents flowing in the capacitors 31*a* and 31*b* exceeds the threshold Ith.

In the fifth to ninth embodiments, the LEDs 40*a* and 40*b* are used as the solid-state light-emitting elements. However, organic EL (Electro-Luminescence) elements may be used.

In the fifth to ninth embodiments, the thyristors 34*a* and 34*b* or the MOSFETs 73*a* and 73*b* are used as the bypass switches. However, other switching elements may be used as well. For example, switching transistors other than MOSFETs may be used.

The constant-current circuit 20 according to the fifth to ninth embodiments may be replaced with another constant-current circuit, e.g., the constant-current circuit 212 shown in FIG. 19, FIG. 22 or FIG. 23.

Further, in the fifth to ninth embodiments, the DC-to-DC converter that performs BCM control is used as the constant-current circuit 20. However, a DC-to-DC converter that performs CCM (continuous current mode) control may be used.

Thus far, the lighting devices of the present invention have been described based on the first to ninth embodiments. However, the present invention is not limited to those embodiments. Aspects implemented by adding a variety of modifications conceived by those skilled in the art to the embodiments or aspects implemented by combining elements in different embodiments also fall within the scope of one or more aspects of the present invention, as long as they do not depart from the gist of the present invention.

In addition, at least a part of the processing units included in the lighting devices according to the first to ninth embodiments may be implemented as an LSI (large-scale integration), which is an integrated circuit. Each of them may be implemented as one chip or some or the whole of them may be implemented as one chip.

The integrated circuit is not limited to an LSI, but may be implemented by a dedicated circuit or a general-purpose processor. A FPGA (field programmable gate array) that can be programmed after an LSI manufacturing, or a reconfigurable processor capable of reconstructing the setting and connections of circuit cells in the LSI may be used.

A part or the whole of the elements in the first to ninth embodiments may be implemented with dedicated hardware or may be implemented by executing software programs appropriate for the elements. The elements may be implemented in a such manner that a program executing unit such as a CPU and a processor reads out a software program stored in a storage medium such as a hard disk and a semiconductor memory to execute it.

In the block diagrams, the division of the functional blocks is merely illustrative. Several functional blocks may be implemented as a single functional block or a single functional block may be divided into several functional blocks. Further, some of functionalities in a functional block may be performed by another functional block. Additionally, similar functionalities of several functional bocks may be performed by single hardware or software in parallel manner or in a time-divisional manner.

The orders in which the steps of the processes are carried out are merely illustrative, and therefore the steps may be carried out in other orders. In addition, some of the steps may be carried out simultaneously (in parallel) with other steps.

The circuit configurations shown in the circuit diagrams are merely illustrative and the present invention is not limited to the circuit configurations. In other words, any circuit that can implement the features of the present disclosure like the above-described circuit configurations is also within the scope of the present disclosure. For example, as long as the same functionality as the above-described circuit configurations is implemented, connecting, in series or in parallel, a switching element (transistor), a resistor or a capacitive element to a particular element is also within the scope of the present invention. In other words, in the above embodiments, a term "connected" refers to not only that two terminals (nodes) are directly connected to each other but also that the two terminals (nodes) are connected to each other through another element, as long as the same functionality is implemented.

The numerical values given above are merely illustrative and the present disclosure is not limited to those values. Further, the logic levels represented as High and Low, and the switching states represented as On and Off are merely illustrative. It is also possible to achieve the same result by using combinations of logic levels or switching states different from those described above. Further, the configurations of the logic circuits described above are merely illustrative. It is also possible to achieve the equal input/output relationship by using different configurations of logic circuits.

While the invention has been shown and described with respect to the embodiments, it will be understood by those skilled in the art that various changes and modifications may be made without departing from the scope of the invention as defined in the following claims.

What is claimed is:

1. A lighting device, comprising:

a constant-current circuit configured to supply a constant current to a plurality of solid-state light-emitting elements connected in series;

a smoothing capacitor connected between output terminals of the constant-current circuit;

a bypass circuit connected in parallel to one or more of the plurality of solid-state light-emitting elements, the bypass circuit configured to bypass the one or more solid-state light-emitting elements;

a detection unit configured to detect whether the one or more solid-state light-emitting elements are open-circuited; and a bypass control unit configured to, when the detection unit detects that at least one of the one or more solid-state light-emitting elements is open-circuited, discharge the smoothing capacitor during a discharge period, and thereafter, bypass the one or more solid-state light-emitting elements through the bypass circuit.

2. The lighting device of claim 1, wherein, during the discharge period, the smoothing capacitor is discharged until a voltage across the smoothing capacitor becomes smaller than a sum of forward voltages of the plurality of solid-state light-emitting elements.

3. The lighting device of claim 2, wherein, during the discharge period, the smoothing capacitor is discharged until the voltage across the smoothing capacitor becomes smaller than a sum of forward voltages of other solid-state light-emitting elements than the one or more solid-state light-emitting elements among the plurality of solid-state light-emitting elements.

4. The lighting device of claim 1, wherein, during the discharge period, the bypass control unit stops the constant-current circuit or reduces a value of the constant current supplied from the constant-current circuit.

5. The lighting device of claim 1, further comprising:

a discharge circuit connected in parallel to the smoothing capacitor, wherein, during the discharge period, the bypass control unit turns on the discharge circuit to discharge the smoothing capacitor.

6. The lighting device of claim 1, wherein the bypass control unit includes a comparator to compare a voltage across the smoothing capacitor with a predetermined reference voltage, and wherein the bypass control unit terminates the discharge period when the voltage across the smoothing capacitor becomes lower than the reference voltage, and thereafter, bypasses the one or more solid-state light-emitting elements through the bypass circuit.

7. The lighting device of claim 1, wherein, after the detection unit detects that said at least one of the one or more solid-state light-emitting elements is open-circuited, the bypass control unit terminates the discharge period after a predetermined time period has elapsed, and thereafter, bypasses the one or more solid-state light-emitting elements through the bypass circuit.

8. The lighting device of claim 7, wherein the discharge period is longer than a time constant of a discharge path through which the smoothing capacitor is discharged.

9. The lighting device of claim 1, wherein the constant-current circuit is a DC-to-DC converter that is supplied with a current from a DC power source, and wherein the constant-current circuit includes:

a switching element;

an inductor through which the current from the DC power source flows when the switching element is turned on;

a diode through which a current discharged from the inductor is supplied to the plurality of solid-state light-emitting elements; and a control unit for controlling on and off of the switching element.

10. The lighting device of claim 1, wherein, while the bypass control unit bypasses the one or more solid-state light-emitting elements through the bypass circuit, the constant-current circuit supplies a current to the remaining solid-state light-emitting elements other than the one or more solid-state light-emitting elements being bypassed.

11. A luminaire, comprising:

a plurality of solid-state light-emitting elements; and a lighting device including:

a constant-current circuit configured to supply a constant current to the plurality of solid-state light-emitting elements connected in series;

a smoothing capacitor connected between output terminals of the constant-current circuit;

a bypass circuit connected in parallel to one or more of the plurality of solid-state light-emitting elements, the bypass circuit configured to bypass the one or more solid-state light-emitting elements;

a detection unit configured to detect whether the one or more solid-state light-emitting elements are open-circuited; and a bypass control unit configured to, when the detection unit detects that at least one of the one or more solid-state light-emitting elements is open-circuited, discharge the smoothing capacitor during a discharge period, and thereafter, bypass the one or more solid-state light-emitting elements through the bypass circuit.

12. A lighting device, comprising:

a constant-current circuit configured to supply a constant current to a plurality of solid-state light-emitting elements connected in series;

a capacitor circuit connected in parallel to one or more of the plurality of solid-state light-emitting elements, the capacitor circuit including a capacitor;

a bypass switch circuit connected in parallel to the one or more solid-state light-emitting elements and to the capacitor circuit, the bypass switch circuit including a bypass switch; and a current detection unit configured to measure a current flowing through the capacitor, wherein the current detection unit turns on the bypass switch when the measured current exceeds a predetermined threshold.

13. The lighting device of claim 12, wherein the capacitor circuit further includes a resistor connected in series to the capacitor, and wherein the current detection unit measures the current based on a voltage across the resistor.

14. The lighting device of claim 12, wherein the current detection unit includes a resistor-capacitor filter to attenuate high-frequency components in the current.

15. The lighting device of claim 12, wherein the bypass switch circuit further includes an impedance element connected in series to the bypass switch.

16. The lighting device of claim 12, wherein the constant-current circuit is a DC-to-DC converter that is supplied with a current from a DC power source, and wherein the constant-current circuit includes:

a switching element;

a control circuit that outputs a signal to control on and off of the switching element;

an inductive element through which the current from the DC power source flows when the switching element is turned on; and a diode through which a current discharged from the inductive element is supplied to the plurality of solid-state light-emitting elements.

17. The lighting device of claim 16, wherein the current detection unit detects a DC component in the current flowing through the capacitor.

18. The lighting device of claim 16, wherein the constant-current circuit is driven in a boundary current mode, and the predetermined threshold is larger than a value of the constant current supplied from the constant-current circuit and is equal to or less than two times the value.

19. A luminaire, comprising:

a plurality of solid-state light-emitting elements; and a lighting device including:

a constant-current circuit configured to supply a constant current to a plurality of solid-state light-emitting elements connected in series;

a capacitor circuit connected in parallel to one or more of the plurality of solid-state light-emitting elements, the capacitor circuit including a capacitor;

a bypass switch circuit connected in parallel to the one or more solid-state light-emitting elements and to the capacitor circuit, the bypass switch circuit including a bypass switch; and a current detection unit configured to measure a current flowing through the capacitor, wherein the current detection unit turns on the bypass switch when the measured current exceeds a predetermined threshold.

* * * * *